US006269500B1

(12) United States Patent
Saringer

(10) Patent No.: US 6,269,500 B1
(45) Date of Patent: Aug. 7, 2001

(54) MECHANISM FOR GENERATING WAVE MOTION

(75) Inventor: John H. Saringer, Stouffville (CA)

(73) Assignee: Saringer Research Inc., Stouffville (CA)

( * ) Notice: Subject to any disclaimer, the term of this patent is extended or adjusted under 35 U.S.C. 154(b) by 0 days.

(21) Appl. No.: 09/443,459

(22) Filed: Nov. 19, 1999

Related U.S. Application Data

(63) Continuation-in-part of application No. 09/121,185, filed as application No. PCT/CA99/00664 on Jul. 23, 1999, now Pat. No. 6,029,294.

(51) Int. Cl.[7] ..... A47B 71/00
(52) U.S. Cl. ..... 5/600; 440/16
(58) Field of Search ..... 5/600, 915; 440/16; 601/53, 49, 61, 51, 98

(56) References Cited

U.S. PATENT DOCUMENTS

| | | | | |
|---|---|---|---|---|
| 2,773,498 | | 12/1956 | Himmelman . | |
| 3,221,702 | * | 12/1965 | Clark . | |
| 3,620,651 | * | 11/1971 | Hugton et al. . | |
| 3,964,316 | | 6/1976 | Abe . | |
| 3,981,612 | * | 9/1976 | Bunger et al. . | |
| 3,995,972 | * | 12/1976 | Nassar . | |
| 4,347,036 | * | 8/1982 | Arnold . | |
| 4,465,941 | * | 8/1984 | Wilson et al. . | |
| 4,486,145 | * | 12/1984 | Eldredge et al. . | |
| 4,595,336 | * | 6/1986 | Grose . | |
| 4,915,584 | * | 4/1990 | Kashubara . | |
| 4,999,861 | * | 3/1991 | Huang | 5/600 |
| 5,009,571 | * | 4/1991 | Smith . | |
| 5,109,558 | * | 5/1992 | Di Blasi | 5/611 |
| 5,267,364 | | 12/1993 | Volk . | |
| 5,324,169 | * | 6/1994 | Brown et al. . | |
| 5,626,555 | * | 5/1997 | Di Blasi et al. | 601/98 |
| 5,708,996 | * | 1/1998 | Marenco | 5/613 |

FOREIGN PATENT DOCUMENTS

| | | | | |
|---|---|---|---|---|
| 836006 | * | 3/1952 | (DE) | 440/16 |
| 0788786 | | 8/1997 | (EP) . | |
| 98/47551 | | 10/1998 | (WO) . | |

* cited by examiner

*Primary Examiner*—Ed Swinehart
(74) *Attorney, Agent, or Firm*—Lynn C. Schumacher; Hill & Schumacher

(57) ABSTRACT

The present invention provides a wave generating apparatus for generating waves in for example beds, chairs and the like. In one aspect the device includes a motor driven crankshaft to which are attached several longitudinal beams. The beams mounted on the crankshafts are offset with respect to each other in such a way as to produce a phase shift between the beams. Each beam is provided with several links pivotally attached at one end to each beam and the links are spaced apart along each beam by a distance equal to the desired wavelength of the wave being produced. The other ends of each link is attached to a flexible membrane which forms a support surface of the bed or chair. The links from the different beams are interleaved at equal phase intervals so as to produce a transvers traveling wave in the flexible membrane so that a complete wave passes during each full rotation of the crankshaft assembly.

42 Claims, 16 Drawing Sheets

MECHANISM FOR GENERATING WAVE MOTION

CROSS REFERENCE TO RELATED APPLICATION

This patent application is a continuation-in-part application of U.S. patent application Ser. No. 09/121,185 filed on Jul. 23, 1998 now U.S. Pat. No. 6,029,294, which is a 371 of PCT/CA99/00664 filed Jul. 23, 1999 entitled Mechanism For Generating Wave Motion which has now been allowed.

FIELD OF THE INVENTION

The present invention relates to a mechanism for generating wave motion, and more particularly the invention relates to beds and chairs having wave generating mechanisms incorporated therein.

BACKGROUND OF THE INVENTION

Patients who are immobilised due to partial or complete paralysis, or are recuperating from major surgery or otherwise bedridden for extended periods of time are often unable to exercise or move sufficiently under their own power. In many cases this is problematic and can lead to complications such as bed sores, and disuse atrophy of joints and soft tissues. Most solutions to this problem involve changing pressure points exerted on the patient's body by the bed or couch on which they are supported. Mattresses having fluidized beds incorporated into the structure or inflatable/deflatable devices are common but these units typically involve complicated mechanisms and circuitry and are quite expensive. A propagating wave through a mattress support is a desirable alternative to these other solutions.

Several types of wave generating devices have been patented. U.S. Pat. No. 3,981,612 issued to Bunger et al is directed to a wave generating apparatus which uses a set of rollers mounted on a carriage that is driven along a set of rails. A flexible sheet is secured at the ends of a frame and as the carriage is driven along the rails the roller displaces the sheet upwardly so that a wave motion is produced along the sheet. This device is quite bulky and is only able to produce one displacement wave for only one set of rollers.

U.S. Pat. No. 4,915,584 issued to Kashubara discloses a device for converting fluid flow into mechanical motion using an airfoil movable within a vertical track. As air flows over the air foil the foil moves vertically up or down in the vertical track thereby transmitting movement to a set of crank arms thereby rotating an axle which is attached at the ends to the two crank arms.

U.S. Pat. No. 4,465,941 issued to Wilson et al is directed to a water engine for converting water flow into other types of mechanical energy. Water flowing toward one side of the device engages a set of butterfly valves and a wheeled carriage is pushed along the frame of the barrage.

U.S. Pat. No. 3,620,651 issued to Hufton discloses a fluid flow apparatus that may operate as a pump or motor. The device includes several flexible sheets driven in oscillatory motion by a bulky crank assembly.

U.S. Pat. No. 4,999,861 issued to Huang describes a therapeutic bed with a wave surface generated through two longitudinal shafts, a multitude of offset cams and a support mechanism.

A PCT patent application PCT/EP98/01276 issued to Nestle S. A. uses a method similar to Huang's wave bed in a peristaltic pump. A longitudinal shaft drives a number of cams that sequentially compress a tube in a wavelike manner.

U.S. Pat. No. 5,267,364 issued to Volk also describes a wave bed activated through inflation and deflation of air pockets.

It would therefore be advantageous to provide a compact wave generating device that can be used for producing wave motion for use in chairs, beds or other therapeutic devices or alternatively may be adapted for converting wave motion into other types of mechanical or electrical energy.

SUMMARY OF THE INVENTION

It is an object of the present invention to provide a mechanism that can be adapted for either generating transverse wave motion or converting wave motion into other forms of useful work.

An advantage of the present invention is that it provides an apparatus for generating transverse wave motion that can be adapted for numerous applications including but not limited to wave beds, wave chairs, wave surfaces and propulsion systems. The mechanism can also be used generally for converting wave motion into other types of useful work including but not limited to rotary motion and electrical power.

In one aspect of the invention there is provided an apparatus for converting rotary motion into wave motion and vice versa. The apparatus comprises a flexible member, a link member rigidly attached to the flexible member at a first end portion thereof and pivotally attached to an oscillatory drive means at the second end thereof. When the oscillatory drive means rotates the second end portion of the link it undergoes oscillatory movement which produces a traveling wave in the flexible member with a wavelength proportional to the length of the link member.

In another aspect of the invention there is provided an apparatus for generating wave motion. The apparatus comprises a flexible member and at least one link member having opposed first and second end portions. The at least one link member is rigidly attached at the first end portion thereof to the flexible member and is pivotally attached at the second end portion thereof to oscillatory drive means for imparting oscillatory motion to the second end portion of the at least one link member so that in operation when the oscillatory drive means is engaged the second end portion undergoes oscillatory motion which produces transverse waves in the flexible member.

In this aspect of the invention, the apparatus includes a plurality of link members attached along the flexible member driven synchronously by the oscillatory drive means to form a continuous traveling transverse wave.

In another aspect of the invention there is provided an apparatus for generating wave motion. The apparatus comprises an oscillatory drive means including a crank assembly and at least two elongate beams each attached to the crank assembly. The oscillatory drive means synchronously drives the at least two elongate beams with a preselected phase angle between the at least two elongate beams. The apparatus includes a flexible member; and the at least two elongate beams each include at least two link members spaced along and pivotally attached at its second end portion to the beam. The at least two link members each have a first end portion rigidly attached to the flexible member and have an effective length so that when the oscillatory drive means is engaged the second end portion undergoes oscillatory motion which produces transverse traveling waves in the flexible member.

BRIEF DESCRIPTION OF THE DRAWINGS

The following is a description, by way of example only, of an apparatus for generating waves constructed in accordance with the present invention, reference being had to the accompanying drawings, in which:

FIG. 13(*b*) is a side view of another embodiment of a wave generating apparatus for producing variable wavelength waves;

FIG. 18(*b*) is a cross sectional view taken along the line 18(*b*)—18(*b*) of FIG. 18(*a*);

FIG. 21(*b*) is a perspective view of the boat and rudder of FIG. 21(*a*);

DETAILED DESCRIPTION OF THE INVENTION

Figure 1:
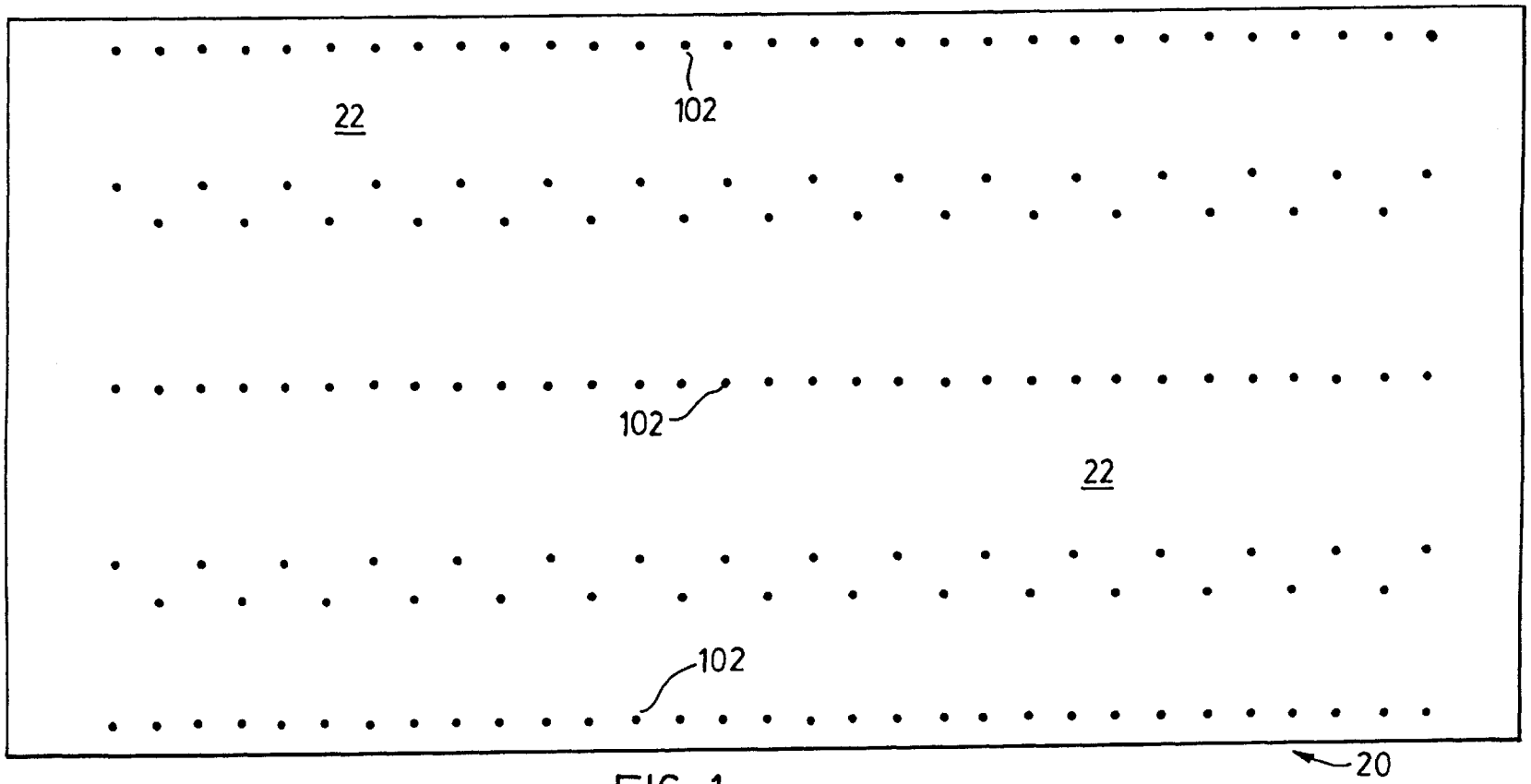
FIG. 1 is a plan view of a bed containing a wave generating apparatus constructed in accordance with the present invention.
Figure 2:
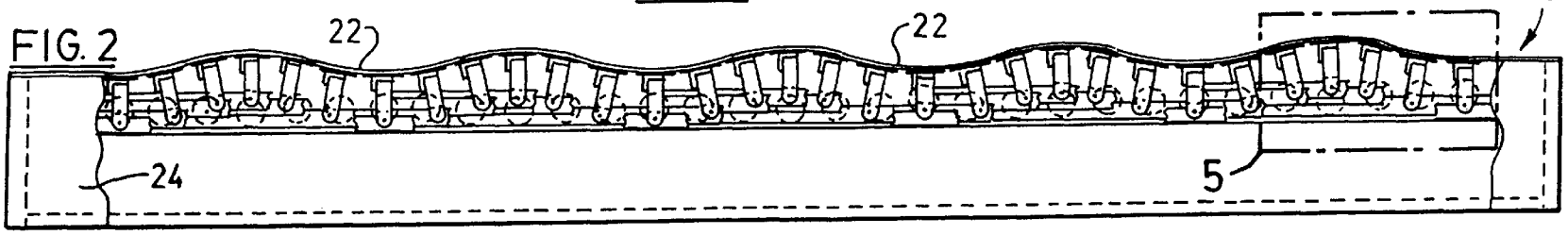
FIG. 2 a side elevation view of the bed, shown in FIG. 1, in part section.
Figure 3:
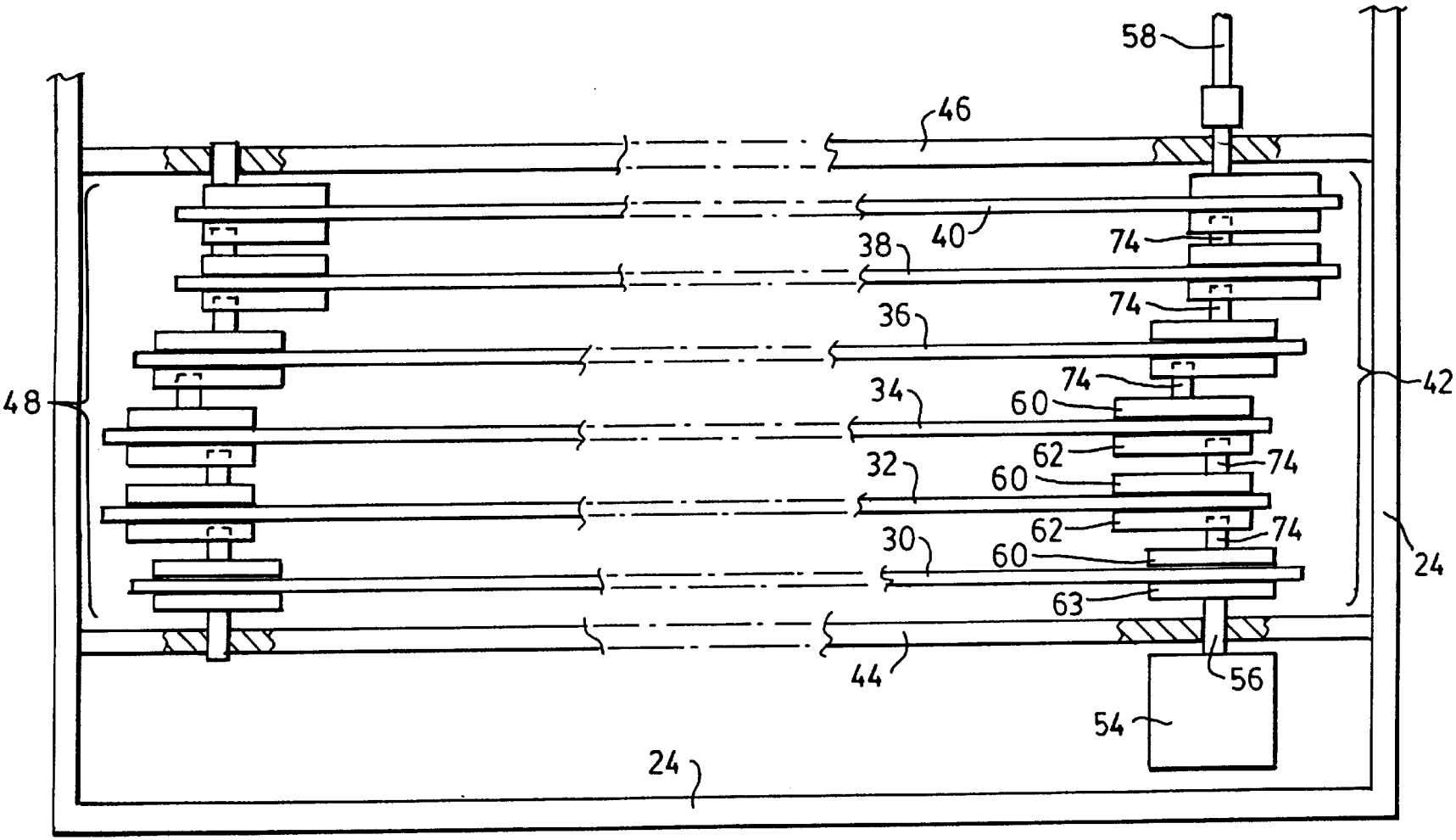
FIG. 3 is an underside view of the links of FIGS. 5 through 10, shown collectively with each arm broken.

Referring first to FIGS. 1 and 2, a wave bed constructed in accordance with the present invention is shown generally at 20. Bed 20 includes a flexible panel member 22 preferably made of a flexible plastic sheet and a support frame 24 (FIG. 2). Referring to FIG. 3 which shows a portion of the underside of the bed, the wave motion generated in bed 20 is developed using a wave generating apparatus that includes a series of six parallel beams 30, 32, 34, 36, 38 and 40 which are attached at one end of each beam to crankshaft assembly 42 mounted between support rails 44 and 46. The other ends of the beams are connected to an idler crankshaft assembly 48, which is not motor driven, mounted between support rails 44 and 46. A gear motor 54 is attached to crankshaft assembly 42 so that rotational motion of gear motor shaft 56 is converted into both lateral up and down movement of each of the beams as well as angular deflection equal to the tangential slope of the driven wave. It is noted that a motor is not essential in that the shaft could be turned manually to same effect. It is also noted that any beam can act as a support beam for a motor or generator with the motor or generator engaging the crankshaft at its respective point of pivoting attachment.

An extension shaft 58 is mounted in support rail 46 which can be attached to an additional bank of wave generating links. Additional banks of wave generating links can be spread across the width of the bed.

Figure 4:
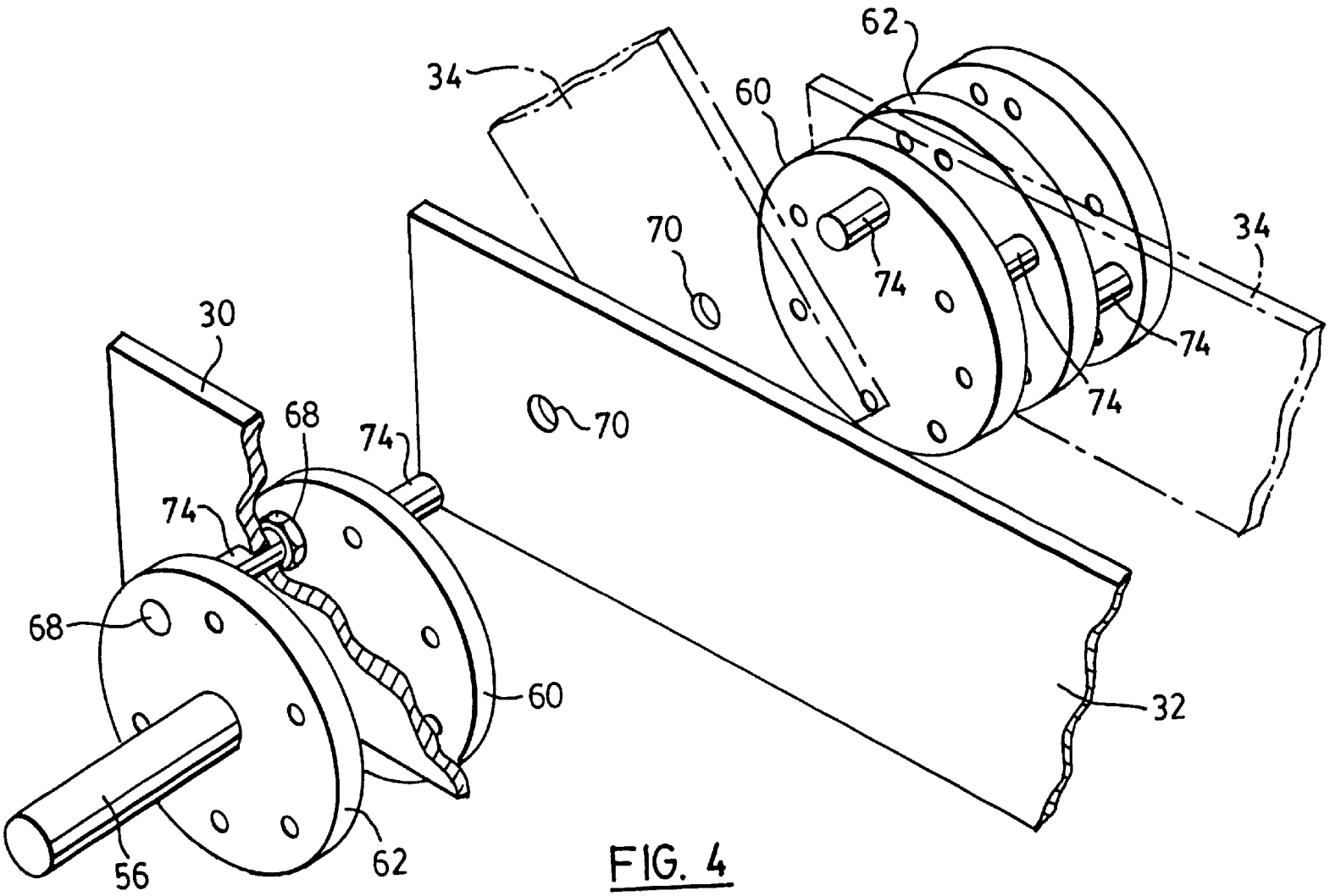
FIG. 4 is a perspective view of a bearing plate exploded from a link arm.

FIG. 4 is a simplified diagrammatic representation of a crankshaft assembly connected to the beams to impart circular motion to the beams which is translated into wave motion along the flexible sheet. A pair of bearing plates 60 and 62 respectively are mounted on either side of each beam, in this case beams 30, 32 and 34. Motor shaft 56 is attached to the center of plate 62 attached to first beam 30. Each plate 60 and 62 is shown with a hole 68 spaced from the perimeter of each bearing plate. A crank pin 74 is inserted through a hole 70 located in the end portion of each beam and is secured in hole 68 in plate 62 on one side of beam 30 and in a hole 68 in plate 60 on the other side of beam 30. In the representation of FIG. 4 each pair of discs 60 and 62 connected by a crank pin 74 through hole 70 in the beam does not move with respect to each other. When drive shaft 56 is driven by the motor the discs rotate about the longitudinal axis of shaft 56 and since the crank pins are offset from this axis the beams are driven in a circular path in planes that are perpendicular to the axis of rotation of the crank. The crank assembly is shown assembled with adjacent crank pins spaced 60° apart since there are six beams making up the bank.

The other ends of each beam in the bank of beams are similarly attached to an idler crankshaft assembly 48 with the difference being no motor is provided (FIG. 3). Each of the six beams 30, 32, 34, 36, 38 and 40 has a unique phase so that each beam is 60° out of phase with all the other beam in the bank so the bank of beams defines a total phase difference of 360°. On each beam, the two bearing plates 60 and 62 remain fixed with respect to each other so that when in operation, as shaft 56 is rotated by motor 54, every point on all the beams undergoes circular motion with a 60° phase difference between the beams.

Figure 5:
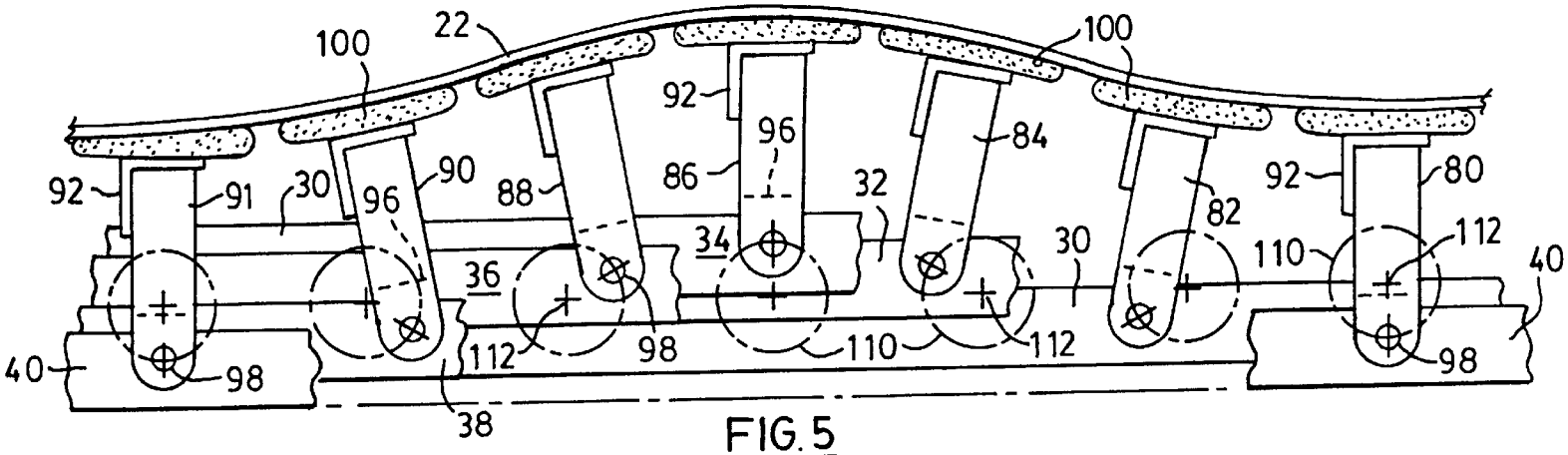
FIG. 5 is an enlarged view of a portion identified as 5 in FIG. 2.
Figure 6:
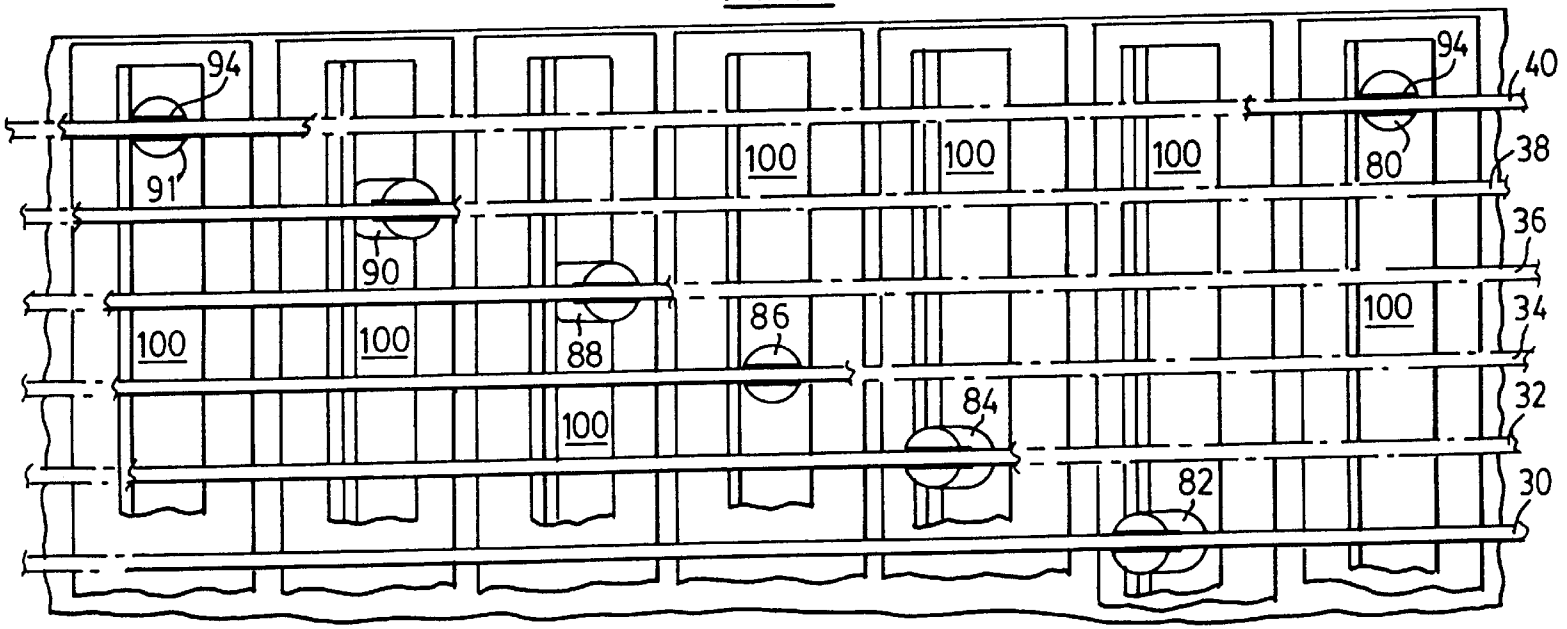
FIG. 6 is an underside view of FIG. 5.
Figure 7:
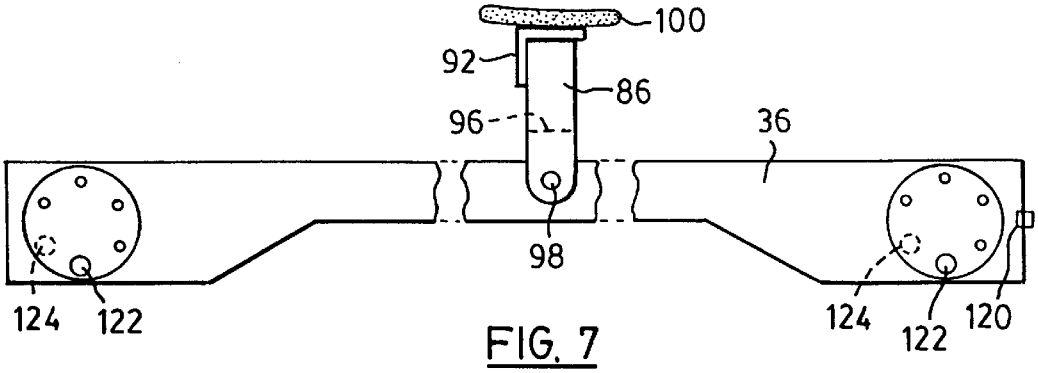
FIGS. 7 to 12 are vertical side elevation views of the link arms shown in FIG. 3 showing one revolution of the present wave generator.
Figure 8:
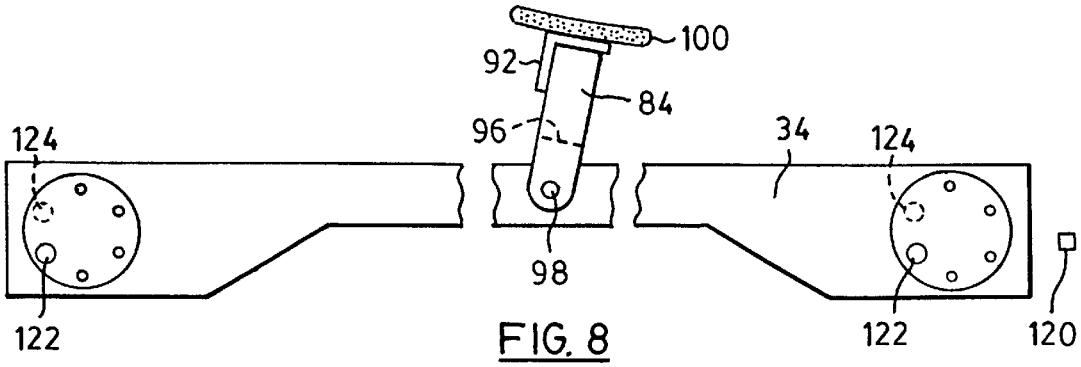
Figure 9:
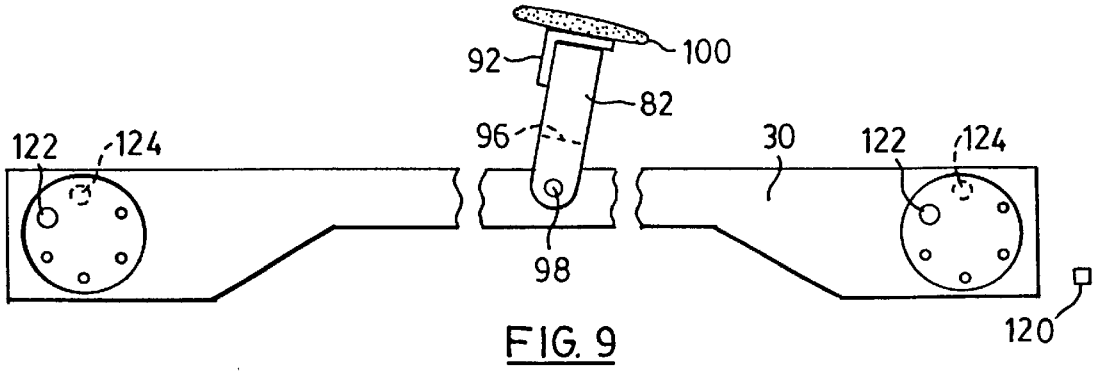
Figure 10:
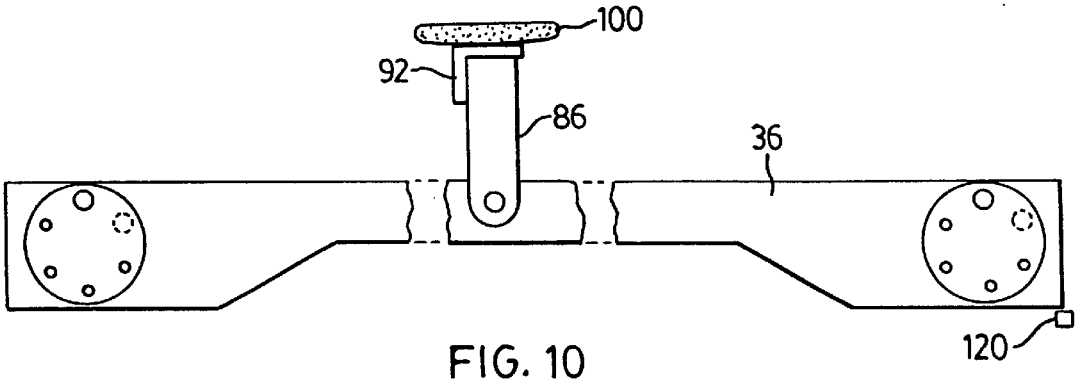

FIG. 5 is an enlarged view of section 5 of FIG. 2 showing seven cylindrically shaped links or drive rods 80, 82, 84, 86, 88, 90 and 91 connected respectively between beams 40, 38, 36, 34, 32, 30 and 40 and the underside of panels 100. These drive rods need not be cylindrical and may be flat if desired. Each of the drive rods is pivotally connected at one end to its associated beam for pivotal movement about pivot point 98 and extends away from the beam in the plane in which the beam moves. FIG. 6 shows the underside of this enlarged section of FIG. 5. Each link is connected at one end to a bracket 92 which in turn is connected to the underside of panel 100. Each cylindrical arm is provided with a slot 94 (FIG. 6) at the other end thereof extending up to dotted line 96 (FIG. 5) with the slot being wide enough to receive therein the associated beam. Panels 100 extend transversely across the underside of flexible sheet 22 and the sheet is attached to the panels by rivets 102, best seen in FIG. 1.

Since each point on each beam, regardless of shape, goes through a circular arc in a plane perpendicular to the axis of rotation of the crank, the drive rods 80, 82, 84, 86, 88 and 80' being pivotally attached to each beam, pivot in the same plane in which the beams undergo circular motion. Therefore, because the drive rods are rigidly connected to flexible sheet 22, when the crankshaft is rotated the circular motion of the beams creates a traveling wave along the flexible sheet, see FIG. 2. When the crank is rotated in one direction transverse waves are produced traveling in one direction in the flexible sheet 22 and reversing direction of rotation of the crank assembly reverses direction of the traveling transverse wave motion.

It will be understood that the idler crankshaft assembly 48 is optional but if present does not need to be located at the other end of the bank of beams. It could be located anywhere along the length of the beams as long as it is spaced from the first crankshaft assembly 42. When the idler crank is present the beams are forced into parallel arrangement so that all parts of the beam undergo circular motion. The motor driven first crank assembly may be positioned where most convenient along the beams and may be attached directly to one of the beams acting as a support. It is also understood that the idler crank is only one way of forcing a parallel arrangement of beams and that various other means may be used with similar effect and function. For example, in the case where the beams are driven synchronously with a crankshaft, any two parallel beams will rotate around the other at all points, so that an offset hinging mechanism can be installed anywhere between any two beams to cause parallel alignment.

In a preferred embodiment a modular wave bed assembly with a bed frame having a central cut-out portion may be provided and a modular wave bed insert may be dropped into the cut-out portion. The modular wave bed insert includes two beams a little shorter than the wave bed surface with the small motor attached to one beam and crank engaging the second beam. The motor and crank are located midway along the length of the beams in the middle of the flexible plastic sheet on its underside. The two beams are connected to a crank with the beams 180° out of phase. The reinforcing panels 100 shown in FIG. 6 may be replaced by reinforcing ribs integrally formed with the sheet. For example when plastic is used to produce the planar flexible supports 22 reinforcing ribs or slats can be produced as an integral part of the sheet. Similarly, the links rigidly connected to the support 22 and pivotally attached to the beams can be molded along with the sheet to form an integrated unit. This reduces the number of components to be assembled thereby simplifying assembly.

Since the modular wave bed insert is a self-contained unit, it can be easily transported. A support frame per se is not required since the unit could be supported on a piece of foam as in a mattress and still operate.

Those skilled in the art will understand that the basic components of the present apparatus for generating transverse wave motion from rotary motion includes a rotating crank, pivotally engaging a link member at one end with the second end thereof rigidly connected to a flexible member in which a transverse wave is induced through the crank rotation, with the wavelength proportional to the link length. A plurality of such crank positions may be synchronously connected through a means such as a beam, each beam attached to pivots one wavelength apart and out of phase with the other beams, and all interconnected through a synchronising crankshaft which fixes the phase differences between the beams. These beams may be flexible or of complex shape to allow the wave to change direction. Alternatively, the synchronising means may be an electrical control of separate drive motors each connected to a crank position, or a chain or belt interconnecting the crank positions, or any combinations thereof.

As mentioned above, when an idler crank assembly or a functionally equivalent mechanical linkage is used to constrain the beams the oscillatory motion is pure circular motion. For example, in the case where the beams are unconstrained by an idler crank the motion of the beams is more broadly described as being oscillatory which may include various parts of each beam undergoing circular, reciprocating and/or elliptical motion. For example, in the case where one end of the beams are constrained to undergo reciprocal movement (constrained by a boss in a slot at one end of the beam) the driven crank assembly drives the portion of the beams local to the point of attachment to the crank in a circular path. In this example the constrained ends of the beams undergo reciprocating motion and the unconstrained ends of the beams undergo elliptical motion in the plane substantially perpendicular to the axis of rotation which produces transverse waves in the flexible sheet.

Figure 29:
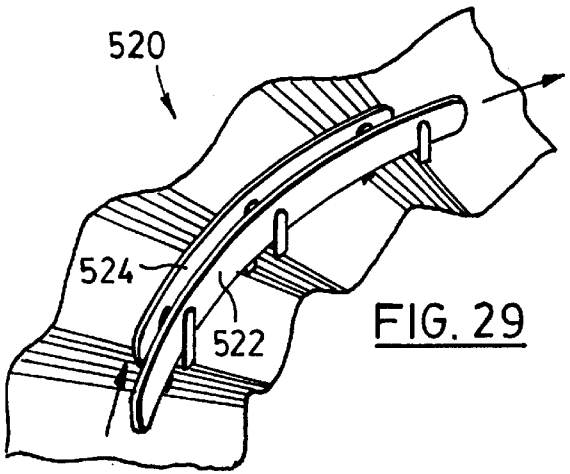
FIG. 29 shows an the wave generating device embodiment with flexible beams and a changing wave trajectory.

Traveling waves of variable amplitude across the width of the flexible sheet can be produced by constraining one edge of the sheet running parallel to the length of the beams so the amplitude increases across the width of the sheet, much like a fan. In this case the beams may be bent into a curve along the direction of wave travel as shown in FIG. 29.

FIG. 5 illustrates one period of a wave generated by the wave generating apparatus and shows the relative positions of the drive rods 80, 82, 84, 86, 88 and 90. The middle drive rod 86 and the end drive rods 80 are vertical as seen in FIGS. 5 and 6 while the remaining links are at different angles from the vertical, also evident in FIGS. 5 and 6. The links on each separate beam are spaced by a distance equal to the desired wavelength. For example, in FIGS. 5 and 6, the two link members 80 on beam 40 are spaced one wavelength apart. The drive rods or links from the six different beams are interleaved at equal phase intervals so as to produce a traveling wave in the flexible panel 22 so that a complete wave passes during each full rotation of the crankshaft assembly 42. The broken circles 110 encircling the center points 112 represent the circular movement defined by the pivot points 98 during operation of the wave generator.

FIGS. 7 to 12 show the individual positions of the different link members in FIGS. 5 and 6 over one wave period. At the right of each drawing is a cross (+) 120 to represent a fixed center of rotation to which the moving links can be referenced against. The crosses 120 are shown at the same end portion of the bed to which the motor driven crank assembly 42 is located.

In alternative embodiments of the wave generating device different number of beams may be used. For example, when four beams are used to generate the wave motion the studs will be at an angle of 90°. Therefore, it will be understood that the angular displacement is calculated by dividing 360° by the number of desired beams to give the required angular displacement between adjacent beams. It should also be noted that an irregular division of angular displacements, while feasible, will necessitate a similarly irregular spacing of links along the flexible member in order to maintain synchronous motion. A regular division of angular displacements results in a regular spacing of links.

Figure 13A:
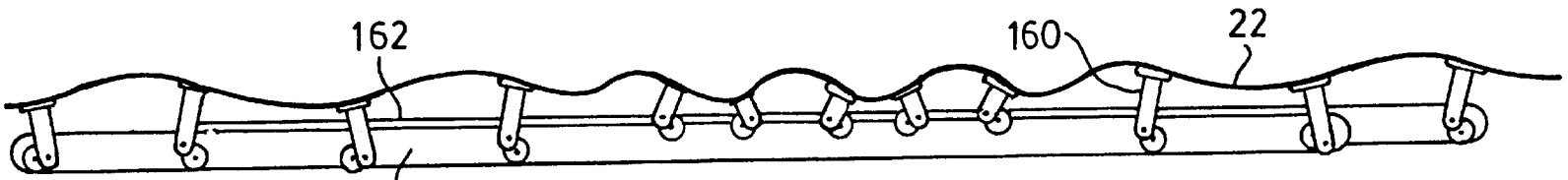
FIG. 13(*a*) is a side view of a wave generating apparatus for producing variable wavelength waves.
Figure 13B:
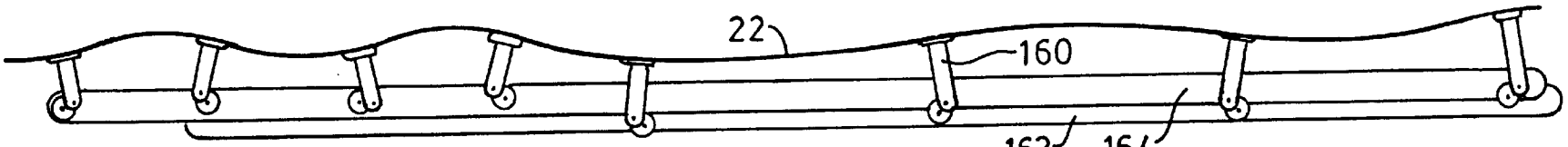

The length of links 82, 84, 86, 88 and 90 determines the amount of angular displacement of the link. It will be understood that the term drive rod and link member refer to the same components. The length of the drive rod or link is determined so that the resultant angle approximately matches the tangential slope of the driven wave at any crank angle. The relationship between wavelength and drive rod length for constant amplitude is illustrated in FIG. 13*a* and 13*b* with drive rods or link members 160 connecting flexible sheet 22 to beams 162 and 164. In FIG. 13(*a*) the wavelength decreases in direct proportion to decreasing length of the drive rods 160 and the distance between the links. In FIG. 13(*b*) the drive rods 160 lengthen as does the distance between the links to create a wave of increasing wavelength in flexible sheet 22. This illustrates the relationship between wavelength and link length with amplitude remaining constant. It also shows how a device with a varying wavelength along its length can be generated from a single mechanism. It also follows that the wave velocity slows down as the wavelength shortens and then speeds up again as the wavelength increases again, since with every turn of the crank the wave moves ahead by one wavelength, whatever the wavelength.

Therefore, traveling transverse waves with preselected wavelength may be produced using the present apparatus by adjusting the length of the link members, the spacing between them on the beams and spatially interleaving the links on the different beams.

The amplitude of the transverse wave is determined by the crank length which is defined as the distance from the center of crank rotation to the point of attachment of a beam to the crank and is equal to one half the total wave amplitude as measured from peak to trough of the wave. Therefore, in the case of circular motion with the crank assembly of FIG. 4, increasing the distance from the center of shaft 56 to the center of pin 74 increases the amplitude of the wave. This corresponds to increasing the radial distance along plates 60 (62) of the attachment point of the beam 30.

Figure 14:
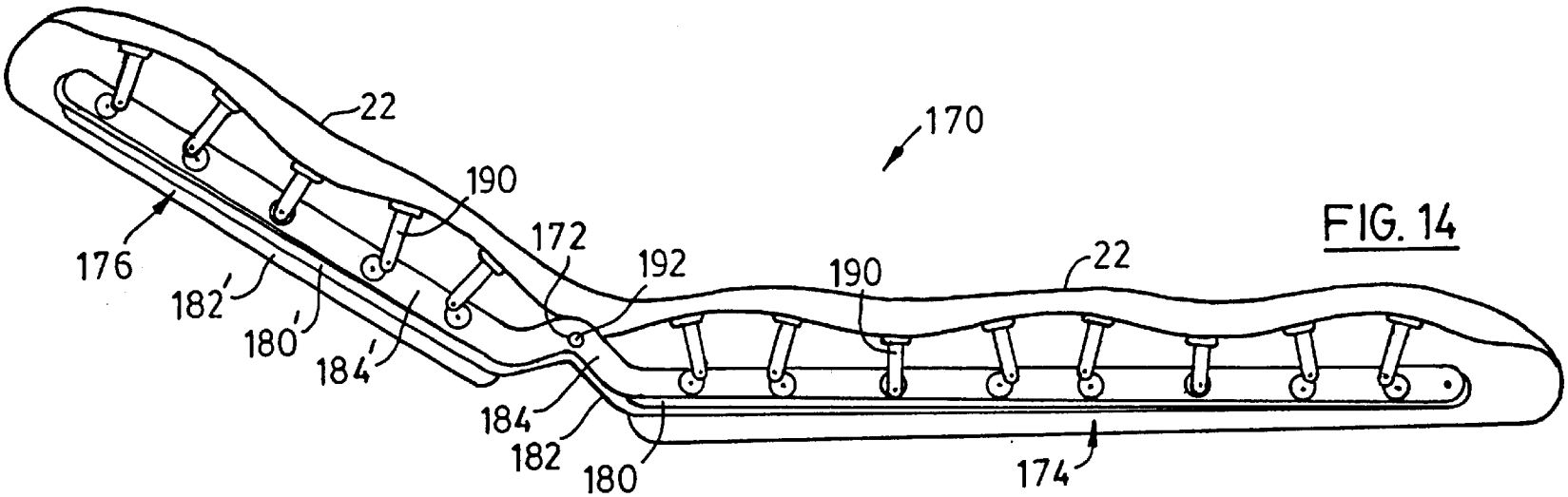
FIG. 14 is another embodiment of a wave bed constructed in accordance with the present invention.
Figure 15A:
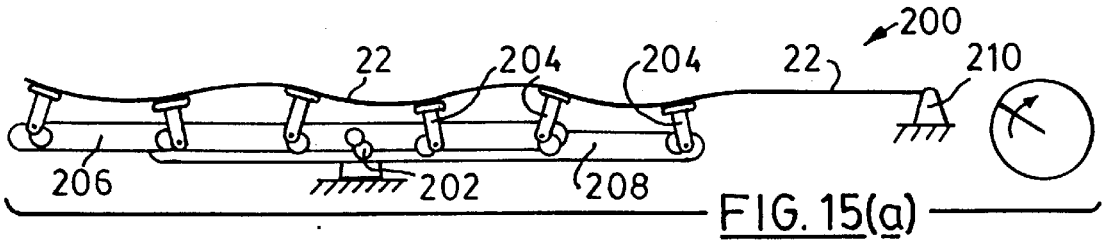
FIGS. 15(*a*) to 15(*f*) illustrate a dual beam wave generating apparatus.
Figure 15B:
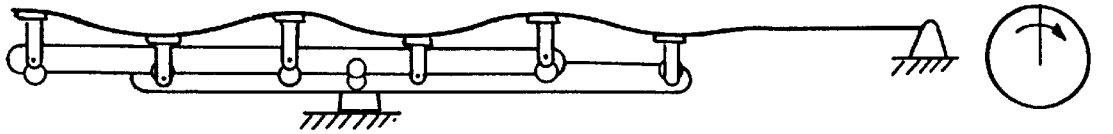
Figure 15C:
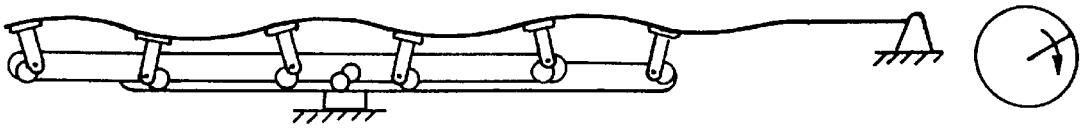
Figure 15D:
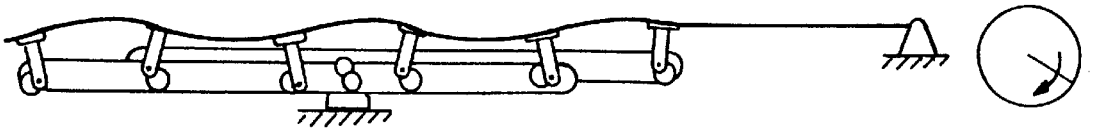
Figure 15E:
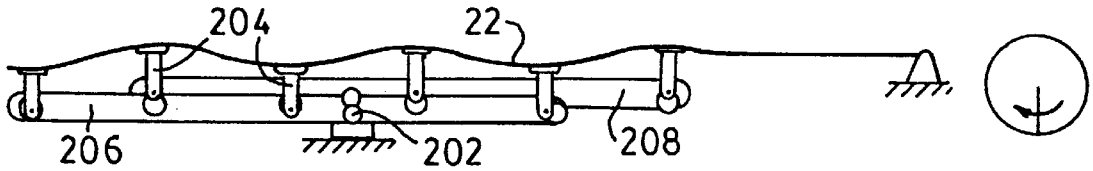
Figure 15F:
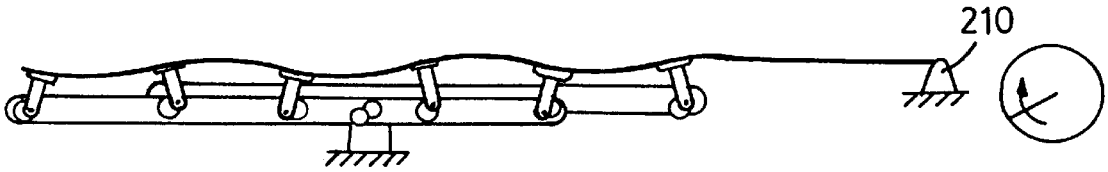

FIG. 14 shows an alternative embodiment of a wave bed with a crankshaft assembly 180, (similar in structure to crankshaft assembly 42 in FIG. 3) joining and transmitting power between two sets of beams 174 and 176. Set of beams 174 includes three beams 180, 182 and 184 respectively connected to beams 180', 182' and 184' in set 176. Idler cranks may be located at the other ends of each bank of beams. Flexible sheet 22 is connected by drive rods 190 to the respective beams. The axis 192 of the crankshaft 180 is located in the plane of the flexible sheet 22 so that flexing at the pivot point between the beams does not elongate the sheet. The beams and drive rods are also located on the two sides of the flexible sheet so that the hinge and beams do not interfere with the flexible sheet. Alternatively the mechanism can be upside down as shown in the side sketch allowing for a more compact packaging. This embodiment allows a single drive means on any crank to transmit power through (multiple) hinged joints and a flexible sheet that not only propagates a wave along its length, but also flexes around hinge points. This can be important in a wave bed since the hinges could allow for the bed to hinge upward as a back support as is required on hospital beds, as illustrated in the sketch or on a reclining chair, etc. FIG. 14 shows the second bar that pivots on a common crank in a 6-beam mechanism. In the 3-beam mechanism, the crank pins are 120 degrees apart rather than 60 degrees as shown.

The progression of FIG. 15(*a*) to 15(*f*) illustrate a dual beam system at 200 comprising a single crank shaft 202 and three drive rods 204 connecting each of beams 206 and 208 to flexible sheet 22. It will be understood that the simplest possible wave generating apparatus according to the present invention would have only two drive rods on each beam. The progression illustrated from FIG. 15(*a*) to 15(*f*) shows the crank angle advancing 60 degrees between consecutive Figures, with the wave advancing one full wavelength through the entire progression back to the start point. The flexible sheet 22 is attached at 210 thereby constraining it from moving horizontally so that it can only move vertically. The beams rotate in a circular arc transmitting a vertical deflection on the flexible sheet as well as imparting a slope equal to the correct tangential angle of the pseudo-sinusoidal wave surface. It is because each drive rod imparts two constraints (vertical deflection as well as slope) to the flexible sheet 22 that a wave can be generated with a minimum of moving parts, optimum mechanical efficiency, and least mechanical complexity.

Figure 16:
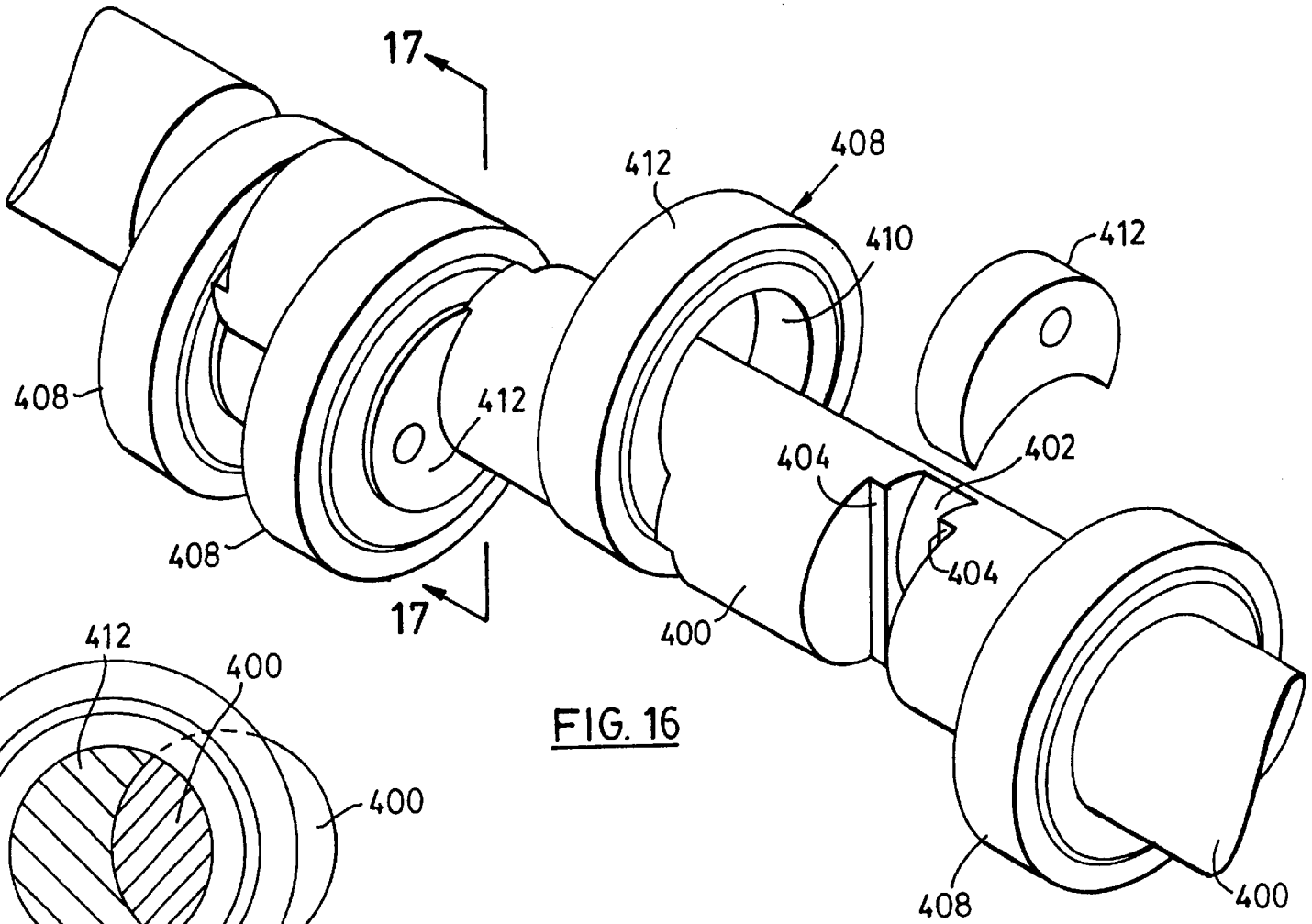
FIG. 16 is a perspective view, broken away, of a crankshaft assembly used for generating wave motion according to the present invention.
Figure 17:
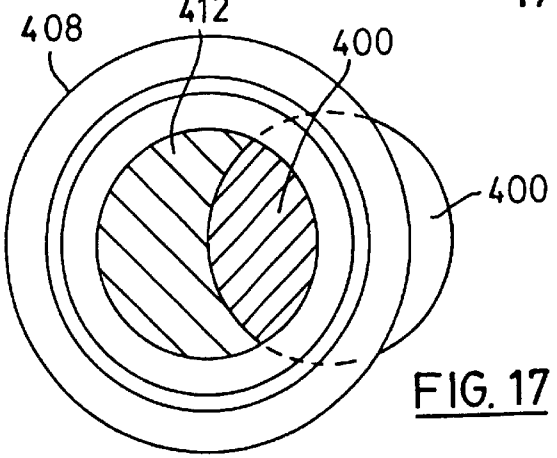
FIG. 17 is a cross sectional view taken along the line 17—17 in FIG. 16.

FIGS. 16, 17, 18(*a*) and 18(*b*) illustrate a preferred embodiment of a crank shaft assembly for a four beam bank with a 90° phase difference between each of the beams in the bank. Referring specifically to FIGS. 16 and 17, a section of a crankshaft 400 is shown with four slotted sections cut out of the shaft. Each slotted cut-out section includes a curved slotted portion 402 and two straight shoulder sections 404 on either side of the curved section 402. A cylindrical bearing assembly 408 with an inner cylindrical section 410 and an outer cylindrical section 412 sits in each slotted section with a portion of the curved surface of inner section 410 of the bearing assembly seated on the curved section 402 machined to have a matching curvature. The bearing assembly 408 is maintained in this position on the shaft 400 by the crescent shaped retainers 412 being inserted between the shaft and the inner curved surface of section 410. The shaft shown in FIG. 16 is used in a four beam bank so the bearings are rotationally displaced from adjacent bearings by a 90° phase difference to give a total of 360°.

Figures 18A, 18B:
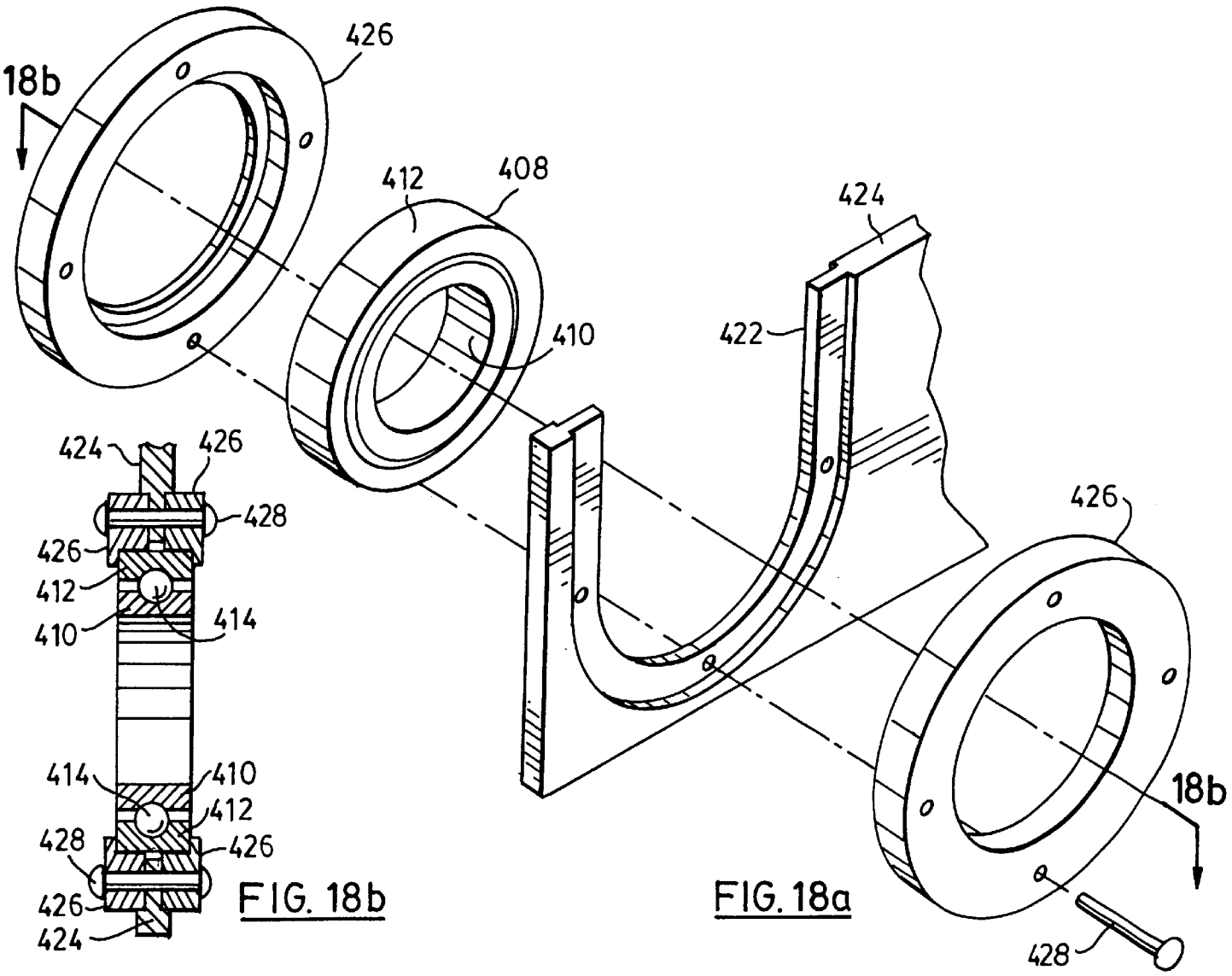
FIG. 18(*a*) is a perspective view of a cylindrical bearing and retaining plates used in the crankshaft assembly of FIG. 16.

Referring to FIGS. 18*a* and 18*b* the end of beam 424 has a cut-out section 422 and a bearing assembly 408 is held in the cut-out section by being clamped between two retaining discs 426 by fasteners 428 through holes in discs 426 and the beam. With the bearing assembly 408 attached to the shaft 400 (FIG. 16) and coupled to beam 424, when the motor drives shaft 400 (FIG. 16) the shaft and inner cylindrical portion 410 rotates over ball bearings 414 with respect to the outer section 412 driving each beam in a circular orbit about the center of the bearing attached to the beam with each beams being 90° out of phase with the preceding beam.

Figure 19:
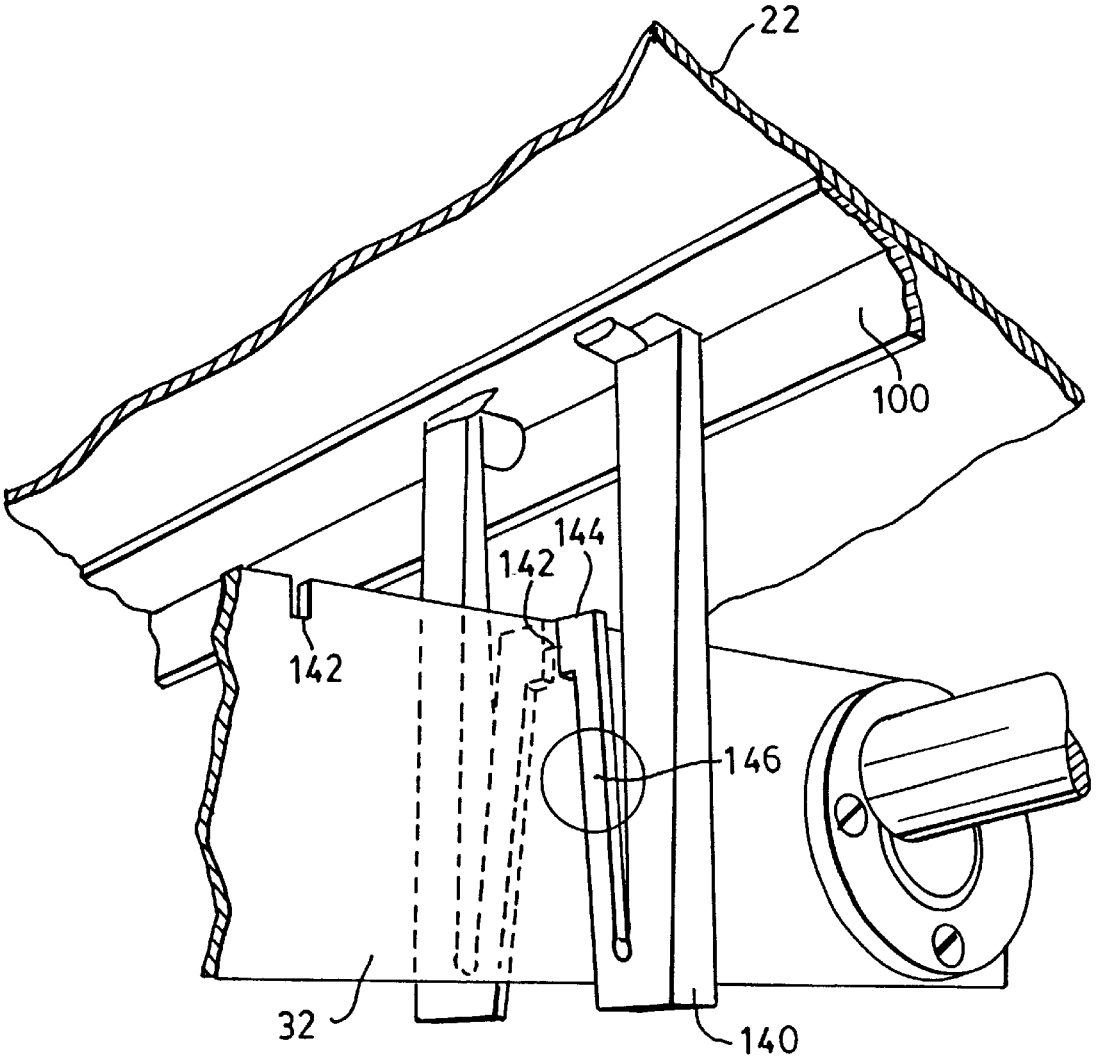
FIG. 19 is a perspective view, broken away, of an alternative embodiment of a connector for connecting a flexible sheet to a beam forming part of the present invention.

While the wave generating apparatus for generating waves in beds, chairs and the like has been described and illustrated with respect to the preferred embodiments, it will be appreciated by those skilled in the art that numerous variations of the invention may be made which still fall within the scope of the invention described herein. For example, because the links only pivot through a small angle, they may be replaced with flexible springs rather than rigid links pivotally connected to the beams. This further simplifies the design and reduces the part count. Referring to FIG. 19, the beams 32' are attached to ribs 100 by flexible spring members 140 thereby connecting the beams to flexible sheets 22. Slots 142 are cut out of the beam and a bracket section 144 of spring member 140 is inserted into the grove to form a friction fit thereby connecting the spring member to the beam. In operation as the beams are driven the springs 140 flex and the beams essentially pivot about the circled region 146.

Additionally, the rigid means may be replaced by a flexible power transmission such as a chain or toothed belt interconnecting and synchronously driving the links at the crank locations.

The elongate beams and flexible sheet may be contoured to follow an anatomical feature to produce for example an ergonometrically favorable device in which the planar flexible member would provide an anatomical support surface. The beams may be flexible to follow a variable curved path in either axis perpendicular to the trajectory of wave travel.

Figure 20:
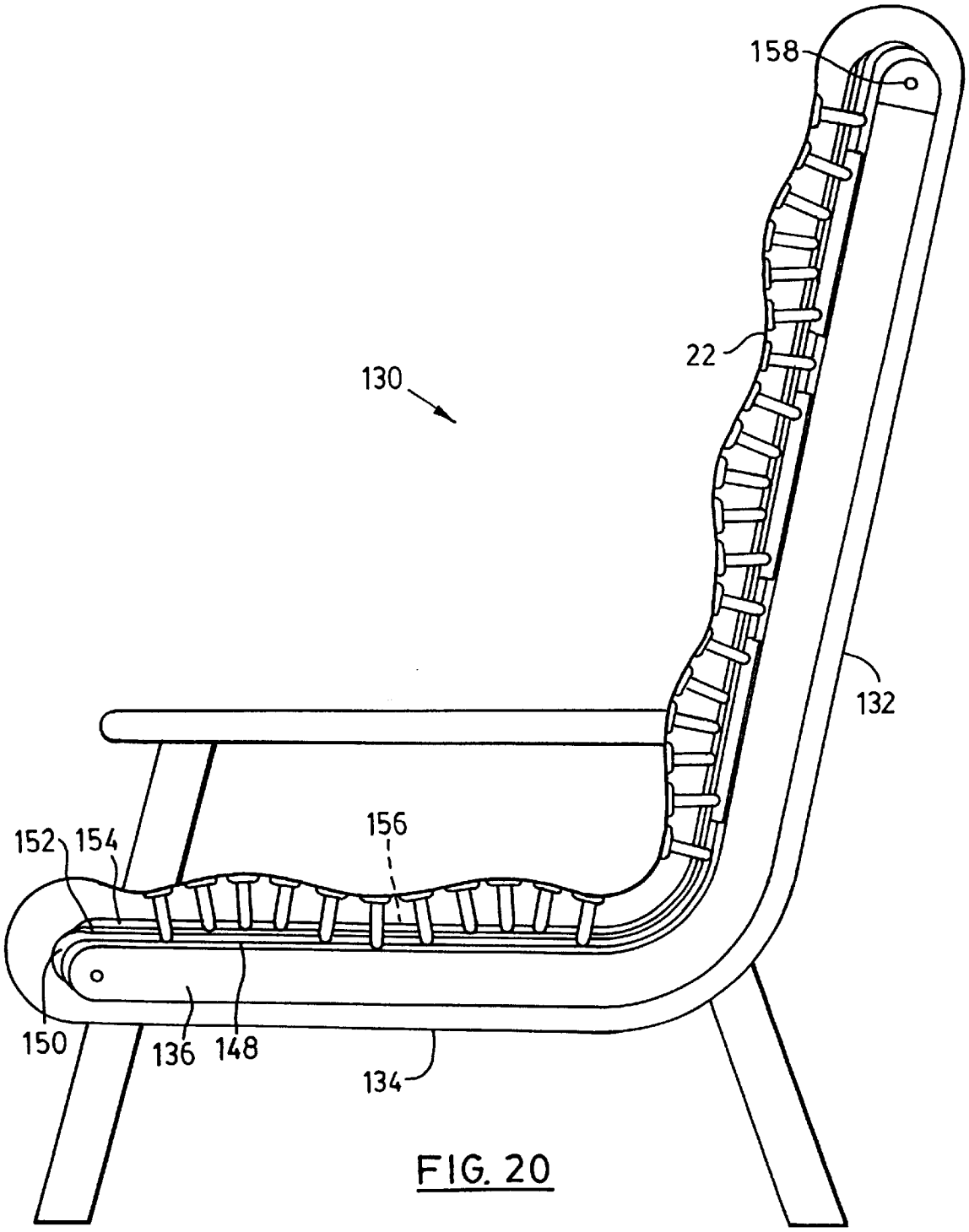
FIG. 20 is a cross sectional side elevation view of a wave chair produced in accordance with the present invention.

Referring to FIG. 20, a wave chair constructed in accordance with the present invention is shown generally at 130 having a back rest portion 132 and a seat portion 134. The beams 136, 148, 150, 152, 154 and 156 are generally L-shaped to provide back rest portion 132 and seat portion 134 with the beams being driven by a drive mechanism 158 similar to the mechanism 42 shown in FIG. 4. Because each point in each beam still undergoes circular motion (regardless of its shape) a traveling wave is produced down the back rest and along the seat portion 134 of chair 130. The chair could also be constructed similar to the bed 170 in FIG. 14 with the two sets of beams pivotally connected together with one set of beams corresponding to a backrest and the other to the seat portion of the chair. The crank and motor can be located at the pivotal connection point of the two sets of beams and idler cranks located at the free ends of each bank of beams. It will be understood that the motor may be attached to any of the cranks, with the non-driven cranks being referred to as idler cranks.

It will be understood by those skilled in the art that only two beams are required to generate synchronized wave motion, however, three beams are necessary to impart rotary movement between the motor driven crank shaft and the idler crankshaft. A two beam mechanism has a point of instability when both the beams are aligned. In that position further rotation of the drive crank will not necessarily cause any rotation of the idler crankshaft. When the two beam system is aligned at the point of instability, the mechanism may lock up or the idler crank may counter-rotate. In a system with at least three beams the beams are never all aligned and are forced to remain parallel, hence there is no point of instability.

Figure 21A:
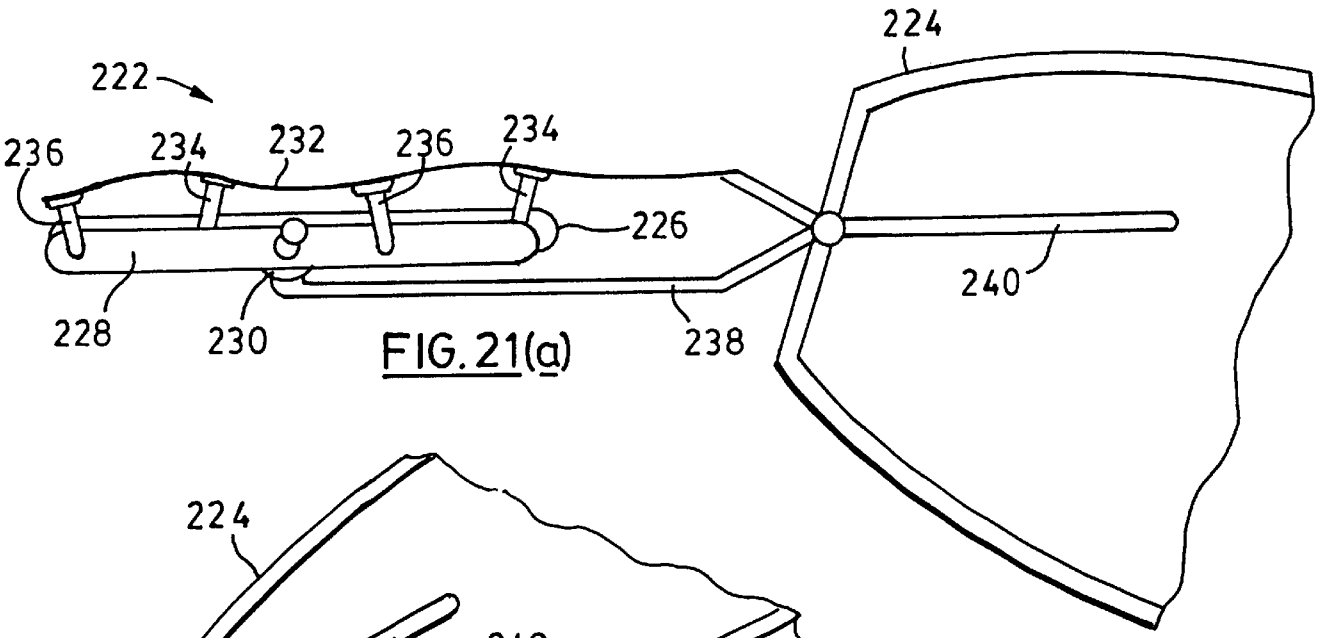
FIG. 21(*a*) is a plan view, broken away, of a boat and wave generating device as a rudder.
Figure 21B:
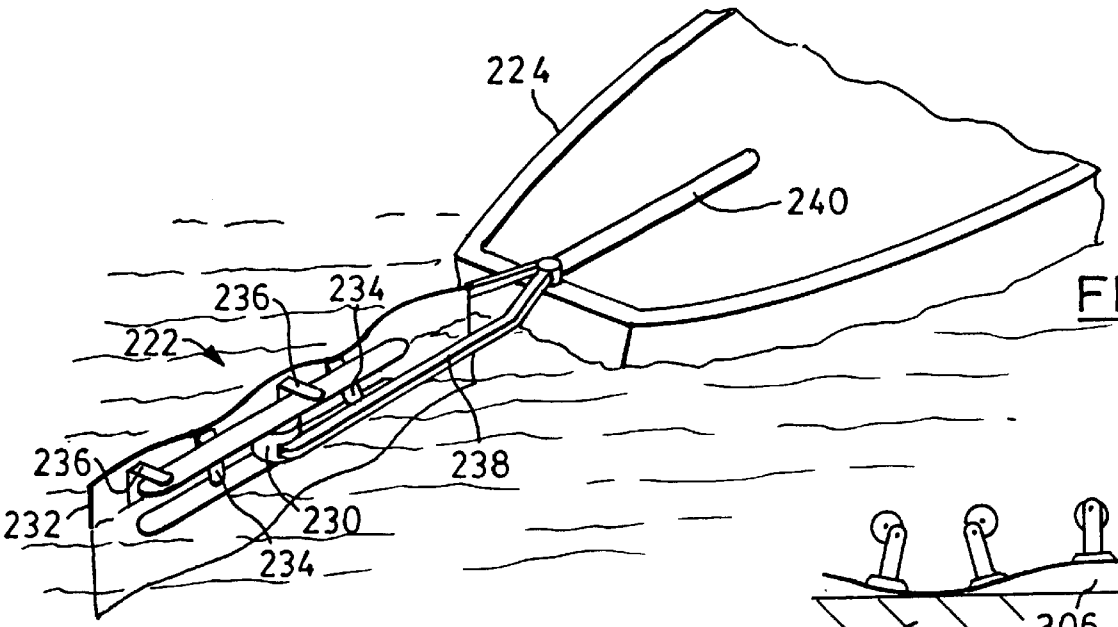

FIGS. 21(*a*) and 21(*b*) show the wave generating mechanism of the present invention being used to construct a self-propelling rudder 222 for a propulsion system for a boat 224. The self-propelling rudder comprises two beams 226 and 228 with a drive motor and crankshaft assembly 230 driving the two beams and producing sinusoidal wave motion on flexible sheet 232 connected to the beam 226 by at least two drive rods 234 and connected to beam 228 by at least two drive rods 236. A motor mounting beam 238 is connected to boat 224 for supporting the motor and crank assembly. Most of the flexible sheet 232 is submerged in the water and also acts as a rudder with the rudder 222 pivotally connected to boat 224 at 238 and hand operated by a tiller 240. The motor/crankshaft mechanism 230 is located above the water line so that only the thin flexible sheet 232 is immersed in order to minimize drag. Applications include all those in which propellers are used in water, air or other media.

A system with a single crank is under constrained in that the shape of the wave is not necessarily sinusoidal since the beams are not forced into a parallel alignment. By pushing down on one end of the flexible sheet, the other end lifts and the wave distorts. This can be an advantage in the case of a propulsion system based on the present wave generating device. In a propulsion system the wave takes on a shape of least resistance to the water so that more of the wave energy goes directly into propulsion. This produces a wave motion that can vary in shape and amplitude along its direction of travel.

Figure 22:
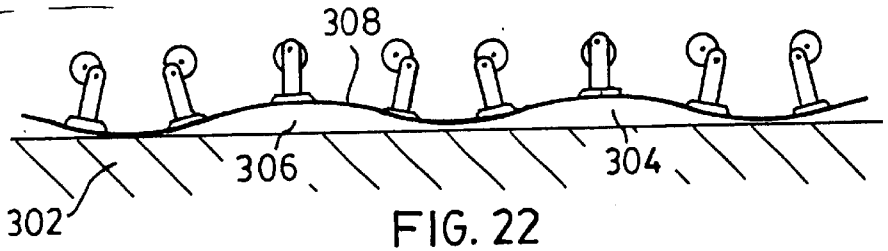
FIG. 22 shows an alternative embodiment of a wave generating device according to the present invention.
Figure 31:
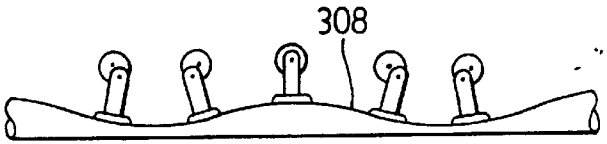
FIG. 31 shows a further alternative embodiment of wave generating device.

FIG. 22 shows a wave generating device 300 adjacent to a rigid surface 302 so that when the device is operating the cavities 304, 306 formed between the flexible membrane 308 and the flat surface moves with the wave. In this configuration the system acts like a peristaltic pump. When combined with the feature of FIGS. 13(*a*) and 13(*b*), the volume of cavities 304 and 306 can be varied along the wave path, thereby compressing or decompressing the fluid as in an air compressor or vacuum pump. Peristaltic pumping through a flexible tube could be achieved for example by replacing flexible sheet 308 with a flexible tube 308', see FIG. 31. Therefore it will be appreciated that the present invention provides a way of producing transverse waves in any flexible member and is not restricted to planar sheets.

Traveling transverse waves are defined as waves in which the wave disturbances move up and down while the waves move in a direction at right angles to the direction of the disturbance. The transverse wave generating mechanism comprises a flexible member defining a wave surface and at least one right angle projection (links) from the wave surface to a pivoting point of attachment to a local cranks. To produce transverse traveling waves multiple right angle projections from the flexible member to pivoting points of attachment are synchronously driven by local cranks. The oscillatory motion of the end portion of each link member pivotally attached to the beam is in a plane defined by orthogonal axes, with one axis being parallel to the direction of travel of the transverse wave travel and the other being parallel to the direction of the wave disturbance which by definition is perpendicular to the direction of wave travel.

Figure 11:
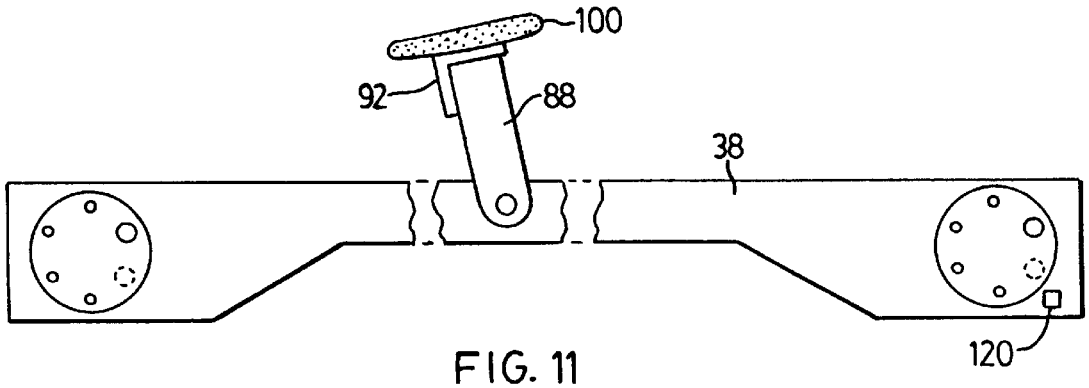
Figure 12:
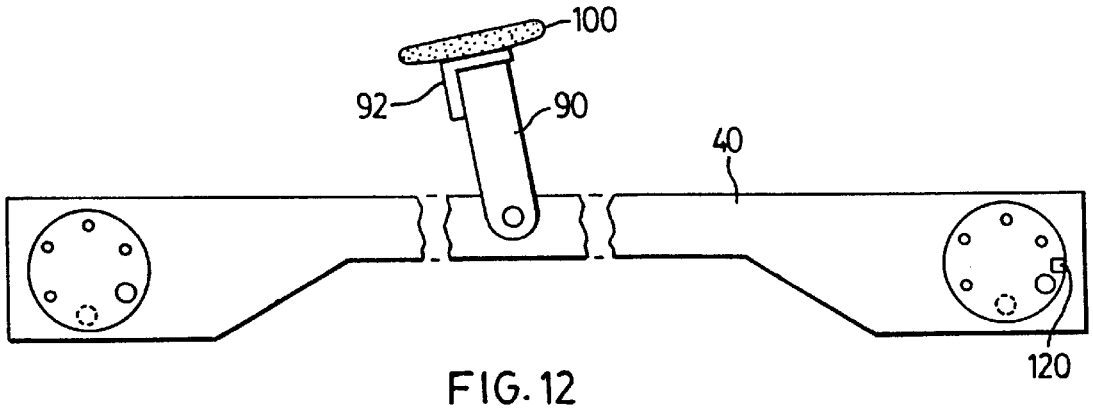

The projection from the wave surface is selected so that the locus of movement of the endpoint of this projection is almost circular. FIG. 22 shows this most clearly. In FIG. 11 elements 100, 92 and 88 collectively constitute the projection of the wave surface 22 to the distal pivot point on the beam 38. The links used in the bed and chair are a specific means of constructing a rigid projection from the planar surface of the wave surface. For very small amplitudes, (±a) relative to the wavelength (w), i.e. $a \ll w$, the locus is almost exactly circular. For amplitudes $a < w/10$, typical of beds and chair applications disclosed herein, the locus is non-circular, therefore a crank driven in a circular path will produce a pseudo-sinusoidal wave, in other words, not exactly a sinusoidal wave but nevertheless functionally equivalent to a sinusoidal wave. For larger relative wave amplitudes, the crank must be driven through a non-circular arc at a non-linear speed otherwise distortions of the wave surface become too large to maintain a functional wave profile. The non-linear rotating speed becomes necessary because, for larger amplitudes, the end of the projection will move significantly faster at certain times in its phase trajectory than at other times. The fact that a projection of a wave surface goes through a point where the locus is pseudo-circular and at a pseudo-constant rate of rotation, within limited ranges of relative wave amplitude, is key to the functioning and limitations of this mechanism.

The drive bars (two or more) are optional. They are means for synchronizing two or more cranks that are in phase with one another and are probably the simplest way of driving several of these cranks from a single source. A single crank, when driving a planar drive bar, effectively provides a very convenient way of delivering the crank rotation to any point of attachment, and specifically to those projected points of attachment where the locus of the wave projections is pseudo-circular. The drawback of this method of synchronizing cranks is that it is rigid. The wave must follow a prescribed path unless sections of the wave are decoupled. A gear/motor could in principle be attached at every crank location and electronically synchronized to generate the wave. In this embodiment there may be a flexible wave path. The cranks may also be coupled with belts or chains and thereby driven from a common source.

It will also be understood that all the drive bars need not be driven from a common crankshaft. Uncoupled drives bars are preferred for higher relative wave amplitudes so that the individual bars may be driven through more precise loci and angular speeds that are phase adjusted. For a high powered, high amplitude wave propellor this configuration would be preferred.

Referring to FIGS. 23 to 26, an embodiment of an apparatus for generating waves with variable amplitude is shown generally at 600. The variable amplitude wave generating device includes flexible sheet 602 in which the transverse waves are developed. Two synchronizing beams 604 and 606 have several links 608 each pivotally attached at one end thereof to the beam and rigidly attached at the other ends thereof to the flexible sheet 602. The links 608 are spaced along each beam with the spacing of the links determining the wavelength of the transverse waves generated in sheet 602. A gear motor 610 is rigidly attached to beam 604 and the motor has a rotary output drive 612. The mechanism includes a variable amplitude crank mechanism including a plate 614 rigidly connected to output drive 612 of the gear motor 610 so that plate 614 rotates with the output drive. A bearing plate 616 includes a shaft 620 and a handle 622 and a center channel 624 extending down the shaft. Shaft 620 passes through a bearing 419 located in a hole through beam 606 and plate 616 is free to rotate with respect to beam 606.

Figure 24:
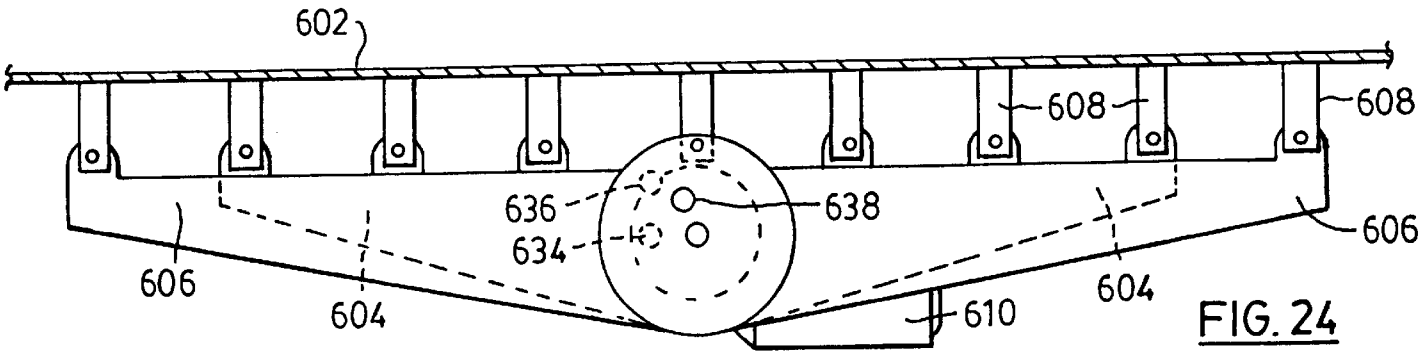
FIG. 24 is a view along line 24—24 of FIG. 23 with the device stationary.
Figure 26:
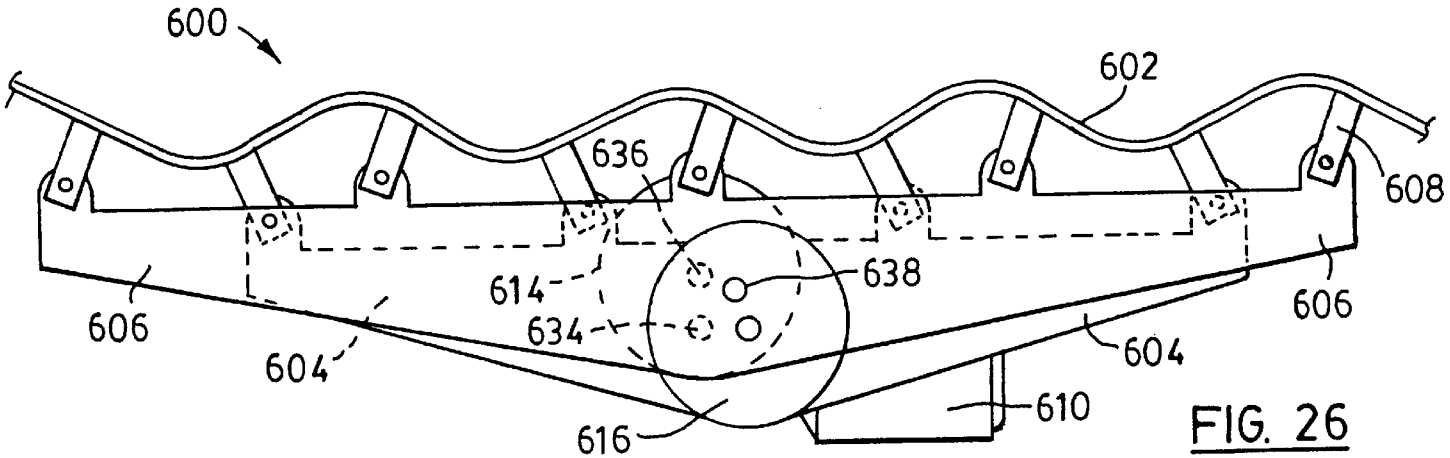
FIG. 26 is a view along line 24—24 of FIG. 23 with the device in operation.

Plates 614 and 616 are pivotally attached by a pin 626 extending through holes in both plates that are offset from the centers of the plates. Thus pin 626 defines a pivot point for rotation of plates 614 and 616 with respect to each other. Plate 614 includes a hole in the center of the plate and a locking pin 628 located in shaft 620 is shown engaged through the center holes of each plate so that the sheet is flat as shown in FIG. 24. Locking pin 628 includes a hand grip 630 for retracting the pin from the plates. Referring specifically to FIG. 26, plate 614 includes several holes 634, 636 and 638 large enough so locking pin 628 can be inserted in each hole.

Figure 23:
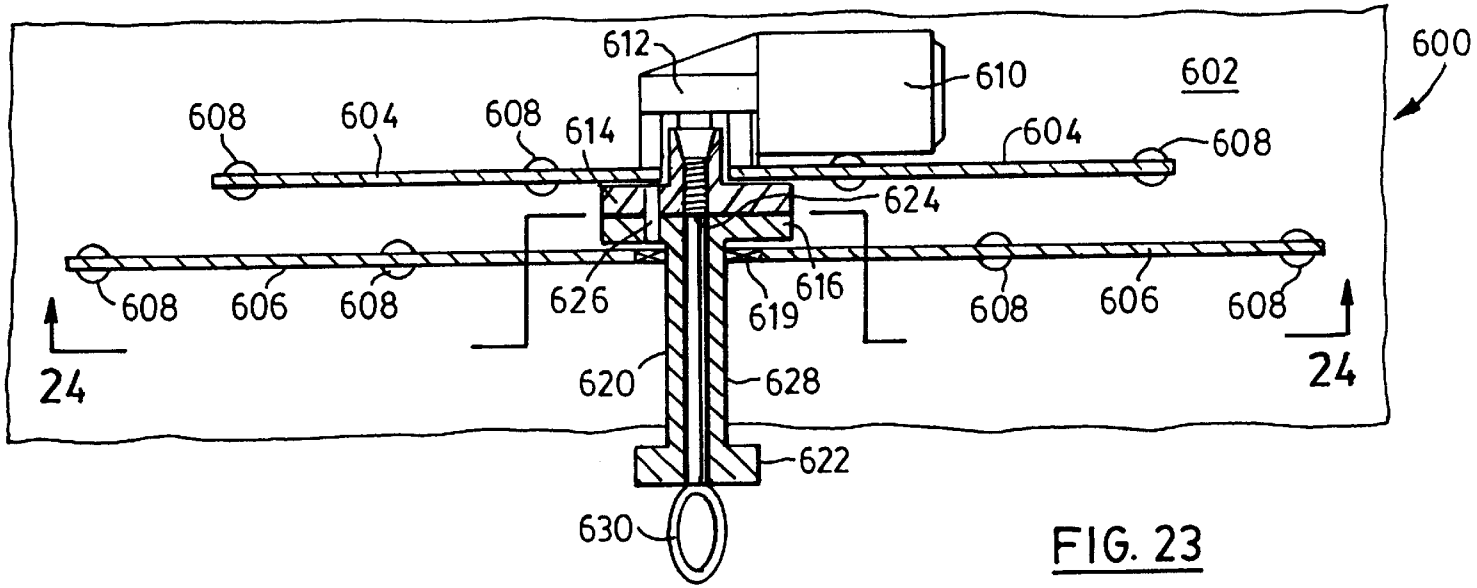
FIG. 23 is a cross sectional view of an alternative embodiment of a wave generating apparatus.
Figure 25:
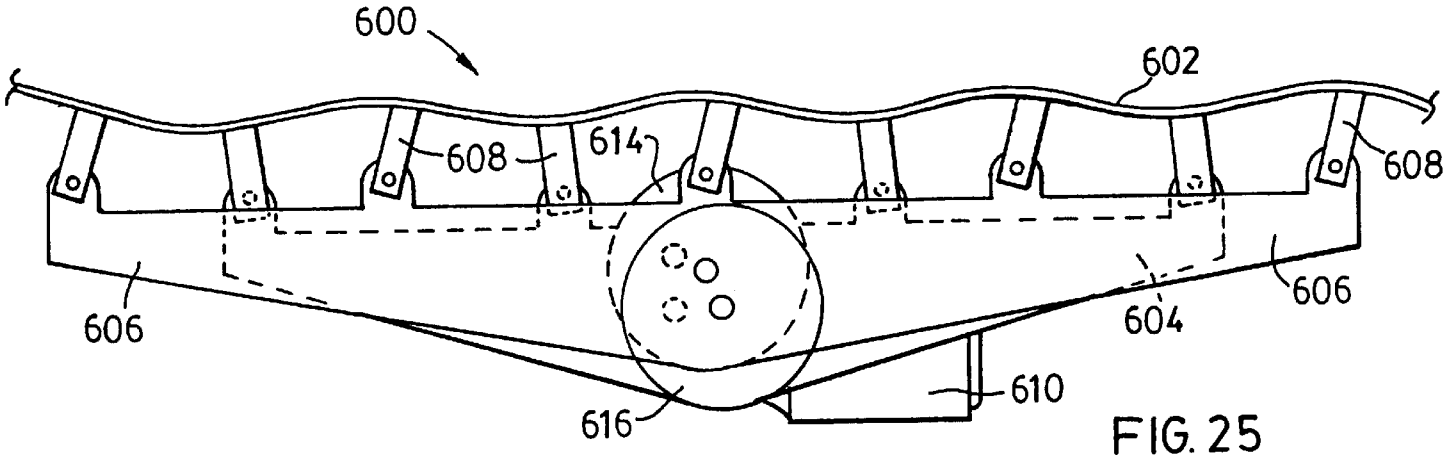
FIG. 25 is a view along line 24—24 of FIG. 23 with the device in operation.
Figure 27:
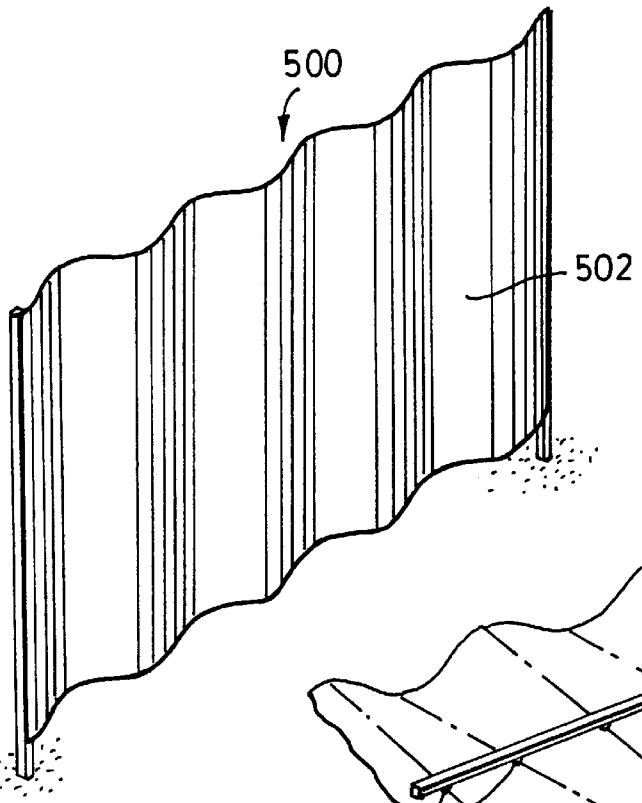
FIG. 27 shows an alternative embodiment of a wave generating apparatus with the wave surface acting as a moving billboard or projection screen.

When the plates 614 and 616 are aligned concentric with each other by locking pin 628 engaged in the center holes of each plate as shown in FIGS. 23 and 24, the flexible sheet 602 is flat. Referring now to FIGS. 26 and 27, the amplitude of the transverse wave generated in the sheet 602 is adjusted by pulling on handgrip 630 to retract pin 628 from the center holes of plates 614 and 616. Once the plates have been unlocked and can rotate with respect to each other, handle 622 is rotated so plate 616 rotates with respect to plate 614 about the pivot point defined by pin 626. Plate 616 is rotated until its center hole 624 (FIG. 23) lines up with one of holes 634, 636 and 638 in plate 614 (FIG. 24) after which pin 628 is inserted into the hole thereby locking the plates together. Upon rotating handle 622, beam 606 pivots with respect to beam 604 to produce a wave in sheet 602 with the amplitude of the wave being dependent upon which hole in plate 614 is aligned with the center hole plate 616. The more handle 622 is rotated the greater the amplitude. FIGS. 25 and 26 show increasing crank offsets with proportional increases in wave amplitude. When gear motor 610 is engaged the output drive 612 rotates bearing plate 614 which also drives plate 616. Since plate 616 is non-concentric with respect to plate 614, plate 616 rotates in a circle about the rotational axis of output drive 612 which produces circular motion in that portion of beam 606 about the hole through which the shaft 620 passes. All points on the beam therefore undergo circular motion. Since beam 604 is also connected in the same way to sheet 602 as beam 606, all points of the beam are forced to simultaneously undergo circular motion as well but with a phase difference relative to beam 604 so that transverse waves are generated in sheet 602.

The embodiment of the variable amplitude wave generating mechanism shown in FIGS. 23 to 26 uses increasing crank offsets to achieve increasing amplitude of the transverse waves. The offset is achieved through coupling two discs off center and rotating one relative to the other. It will be understood that various other methods may be used for achieving the same result.

FIG. 27 shows a billboard device at 500 using the wave generating device disclosed herein with the wave surface 502 acting as a moving billboard, mirrored surface or projection screen. Using the wave generating device permits the production of a moving image from a static image. Coating the wave surface with a holographic motif produces a visually interesting and eye catching result.

Figure 28:
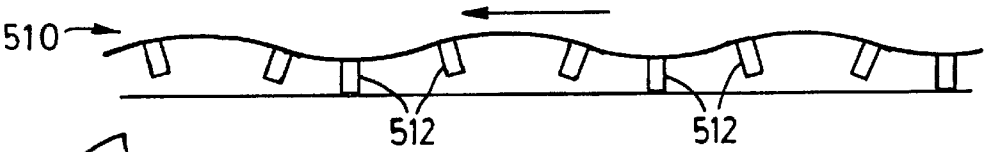
FIG. 28 shows another alternative embodiment of a wave generating apparatus with the wave surface combined with walking feet.

FIG. 28 shows the wave generating device 510 combined with walking feet 512 so that in operation the device essentially "walks" in the direction of the traveling waves indicated by the arrow. The walking feet at 512 represent projections of the wave surface to points of contact to a surface such as the ground. The endpoints of the feet 512 move opposite to the direction of wave travel at the point of contact and reverse direction as they lift from the surface, giving rise to a walking or caterpillar type of movement in the direction of wave travel.

FIG. 29 shows the present wave generating device 520 provided with flexible beams 522 and 524 and a changing wave trajectory.

Figure 30:
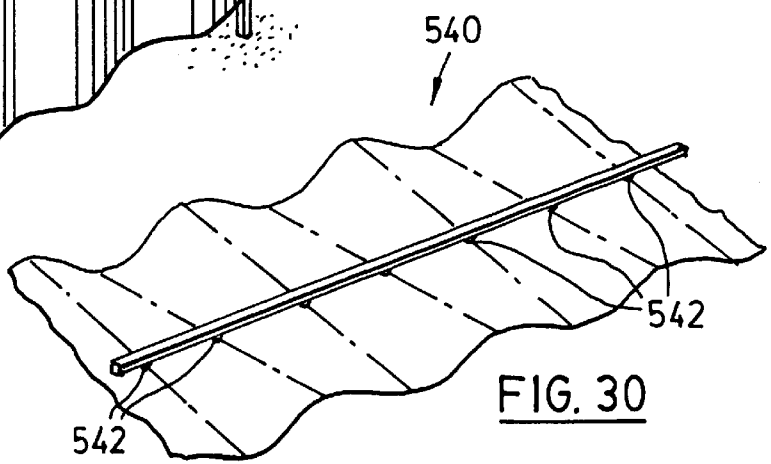
FIG. 30 shows an alternative embodiment with the wave movement translated through pivot points to create a mirrored projection through a bulkhead.

FIG. 30 shows an alternative embodiment of a wave generating apparatus at 540 with the wave movement translated through pivot points 542 to create a mirrored projection of the wave through a bulkhead.

It will be understood to those skilled in the art that there is tremendous flexibility in how the basic aspects of this invention can give rise to a very broad range of possible embodiments and applications and that the embodiments contained herein are only a few among numerous possibilities.

Therefore, the foregoing description of the preferred embodiments of the invention has been presented to illustrate the principles of the invention and not to limit the invention to the particular embodiment illustrated. It is intended that the scope of the invention be defined by all of the embodiments encompassed within the following claims and their equivalents.

Therefore what is claimed is:

1. An apparatus for generating wave motion, comprising;

a) a flexible member;

b) at least one link member having opposed first and second end portions, the at least one link member being rigidly attached at the first end portion thereof to said flexible member; and c) oscillatory drive means, the at least one link member being pivotally attached at the second end portion thereof to the oscillatory drive means for imparting oscillatory motion to the second end portion of the at least one link member so that when the oscillatory drive means is engaged the second end portion undergoes oscillatory motion which produces transverse waves in the flexible member.

2. The apparatus according to claim 1 wherein the at least one link member is a plurality of link members, and wherein said oscillatory drive means synchronously drives said plurality of link members with an effective phase between each link member to produce transverse traveling waves in the flexible member.

3. The apparatus according to claim 2 wherein the oscillatory motion of the second end portion of each link member is in a plane defined by an orthogonal axes, with one axis being parallel to a direction of wave travel and the other being perpendicular to the direction of wave travel and parallel to a direction of wave disturbance.

4. The apparatus according to claim 3 wherein said oscillatory drive means produces circular motion.

5. The apparatus according to claim 4 wherein the flexible member is a substantially planar flexible member.

6. The apparatus according to claim 5 wherein the oscillatory drive means includes a crank assembly having an axis of rotation, including at least two elongate beams each having a crank attachment position radially offset from said axis of rotation and being attached to said crank assembly at said crank attachment position, said crank attachment positions on said at least two beams being offset from each other by a preselected angular displacement, wherein the at least one link member is a plurality of link members spaced along said at least two elongate beams with each link member being pivotally attached at its second end portion thereof to its associated beam, and wherein the oscillatory drive means synchronously drives the at least two elongate beams with an effective phase between each other so that transverse traveling waves are produced in the planar flexible member.

7. The apparatus according to claim 6 wherein the crank means is rotatable in the clockwise and counterclockwise direction, and wherein when said crank assembly is rotated clockwise traveling transverse waves are produced in said planar flexible member in one direction and when said crank assembly is rotated counterclockwise traveling transverse waves are produced in said planar flexible member in the opposite direction.

8. The apparatus according to claim 7 wherein said link members each have an effective length, wherein the wavelength is proportional to the effective length, and wherein the link members pivotally attached to any one beam are spaced from each other one wavelength apart and positioned relative to the links on all remaining beams in a preselected interleaved spatial configuration to produce transverse traveling waves of preselected wavelength.

9. The apparatus according to claim 8 including a bed frame, the planar flexible member being supported by the bed frame and being sufficiently large to form a wave bed surface for a user to lie upon.

10. The apparatus according to claim 9 wherein the planar flexible member and link members are molded or extruded as a one piece integrated structure.

11. The apparatus according to claim 9 wherein said oscillatory drive means and crank assembly are attached to the at least two beams substantially midway along the beams.

12. The apparatus according to claim 11 including at least one idler crank assembly interconnecting the at least two beams spaced from said crank assembly.

13. The apparatus according to claim 9 wherein said oscillatory drive means and crank assembly are attached to the at least two beams at one end portion of said elongate beams.

14. The apparatus according to claim 13 including at least one idler crank assembly interconnecting the at least two beams spaced from said crank assembly located at the other end portion of said elongate beams.

15. The apparatus according to claim 9 wherein the oscillatory drive means produces circular motion, and wherein all of said link members have substantially equal length to produce a substantially sinusoidal traveling wave of constant wavelength.

16. The apparatus according to claim 8 including a chair frame, the planar flexible member being supported by the chair frame and being sufficiently large to form a wave support surface for a user to sit and recline upon.

17. The apparatus according to claim 16 wherein said at least two beams are curved to provide a seat portion and a back rest portion.

18. The apparatus according to claim 17 wherein the oscillatory drive means and the crank assembly are connected at one end portion of the beams and an idler crank is located at the other end portion of the beams.

19. The apparatus according to claim 16 wherein said at least two beams includes at least a first set of beam members and a second set of beam members, all of said first set of beam members defining a first support section and all of said second set of beam members defining a second support section, the first support section being pivotally movable and lockable with respect to the second support section.

20. The apparatus according to claim 19 wherein the first support section is a backrest section and the second support section is a seat section.

21. The apparatus according to claim 19 wherein said oscillatory drive means and said crank assembly interconnects said first and second set of beams at a pivotal connection between the two sets of beams.

22. The apparatus according to claim 21 including a first idler crank assembly interconnecting the first set of beams at an end portion thereof, and a second idler crank assembly interconnecting the second set of beams located at an end portion of the second set of beams.

23. The apparatus according to claim 16 wherein the planar flexible member and link members are are molded or extruded as a one piece integrated structure.

24. The apparatus according to claim 8 wherein said at least two elongate beams is two elongate beams.

25. The apparatus according to claim 24 wherein the oscillatory drive means is mounted on a support frame member connected to a tiller attachable to a boat, and wherein said flexible member descends downwardly from said beams, wherein when said apparatus is connected to a boat in a body of water a portion of said planar flexible membrane is located below a surface of a body of the water and traveling transverse waves produced along said planar flexible member provides propulsion.

26. The apparatus according to claim 25 wherein said oscillatory drive means and the crank assembly are connected to the two beam substantially midway along the beams.

27. The apparatus according to claim 3 wherein said link members are flexible spring connectors each attached rigidly at one end thereof to the planar flexible member and at the other end thereof to an associated elongate beam, and wherein each spring connector flexes at an effective pivot point between the ends.

28. The apparatus according to claim 7 wherein the substantially planar flexible member is any one of a billboard having a visual motif, mirrored surface and projection screen.

29. The apparatus according to claim 4 wherein the flexible member is an elongate flexible tube for material to be pumped therethrough.

30. The apparatus according to claim 7 wherein projections from effective positions on the planar flexible member to a support surface produce a walking motion of the apparatus on the support surface.

31. The apparatus according to claim 7 wherein each elongate beam has a curvature along its length thereof to follow a curved path in either axis perpendicular to the trajectory of wave travel.

32. The apparatus according to claim 31 wherein the elongate beams and flexible member are contoured to follow a person's anatomical profile, and wherein the planar flexible member is an anatomical support surface.

33. The apparatus according to claim 7 wherein the beams are flexible following a variable curved path in either axis perpendicular to the trajectory of wave travel.

34. The apparatus according to claim 3 wherein the oscillatory drive means includes a crank assembly having an axis of rotation, and wherein the crank assembly includes adjustment means for providing a crank length adjustment between the at least first and second elongate beams for adjusting an amplitude of the transverse traveling waves.

35. The apparatus according to claim 8 wherein the oscillatory drive means includes a crank assembly having an axis of rotation, and wherein the crank assembly includes adjustment means for providing a crank length adjustment between the at least first and second elongate beams for adjusting an amplitude of the transverse traveling waves.

36. The apparatus according to claim 5 including elongate ribs attached to the planar flexible member extending along a direction perpendicular to the direction in which the travelling waves propagate for stiffening the planar flexible member.

37. The apparatus according to claim 14 wherein the oscillatory drive means produces circular motion, and wherein all of said link members have substantially equal length to produce a substantially sinusoidal traveling wave of constant wavelength.

38. An apparatus for generating wave motion, comprising;

a) oscillatory drive means including a crank assembly;

b) at least two elongate beams each attached to said crank assembly, wherein the oscillatory drive means synchronously drives the at least two elongate beams with a preselected phase angle between the at least two elongate beams; and c) a flexible member, the at least two elongate beams each including at least two link members spaced along and pivotally attached at a second end portion of the link member to the beam, the at least two link members each having a first end portion rigidly attached to the flexible member, the at least two link members having an effective length so that when the oscillatory drive means is engaged the second end portion undergoes oscillatory motion which produces transverse traveling waves in the flexible member.

39. The apparatus according to claim 28 wherein the oscillatory motion of the second end portion of each link member is in a plane defined by orthogonal axes, with one axis being parallel to a direction of wave travel and the other being perpendicular to the direction of wave travel and parallel to a direction of wave disturbance.

40. The apparatus according to claim 29 wherein said link members each have an effective length and the link members pivotally attached to any one beam are spaced from each other an effective distance and positioned relative to the links on all remaining beams in a preselected interleaved spatial configuration to produce transverse traveling waves of preselected wavelength and amplitude.

41. The apparatus according to claim 29 wherein the oscillatory drive means includes a crank assembly having an axis of rotation, and wherein the crank assembly includes adjustment means for providing a crank length adjustment between the at least first and second elongate beams for adjusting an amplitude of the transverse traveling waves.

42. The apparatus according to claim 39 wherein the adjustment means includes a first drive plate and a second drive plate each having an axis of rotation, the first drive plate being rigidly attached to a drive shaft of the oscillatory drive means having a rotational axis co-linear with the axis of rotation of the first drive plate, the second drive plate being pivotally attached to said first drive plate at a position radially off-center from the axis of rotation of both drive plates and including locking means for locking the second drive plate with respect to the first drive plate in at least one position.

* * * * *